US010077925B2

(12) United States Patent
Horiuchi

(10) Patent No.: US 10,077,925 B2
(45) Date of Patent: Sep. 18, 2018

(54) REFRIGERATION APPARATUS

(71) Applicant: DAIKIN INDUSTRIES, LTD., Osaka-shi, Osaka (JP)

(72) Inventor: Naoto Horiuchi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 170 days.

(21) Appl. No.: 15/070,843

(22) Filed: Mar. 15, 2016

(65) Prior Publication Data

US 2016/0273816 A1 Sep. 22, 2016

(30) Foreign Application Priority Data

Mar. 20, 2015 (JP) ..... 2015-057393

(51) Int. Cl.
*F25D 21/06* (2006.01)
*F25B 13/00* (2006.01)
(Continued)

(52) U.S. Cl.
CPC ..... *F25B 13/00* (2013.01); *F25B 25/005* (2013.01); *F25B 47/025* (2013.01);
(Continued)

(58) Field of Classification Search
CPC ..... F25B 13/00; F25B 25/005; F25B 49/025; F25B 47/025; F25B 2600/2509; F25B 2400/13; F25B 2313/0315
See application file for complete search history.

(56) References Cited

U.S. PATENT DOCUMENTS 5,436,547 A * 7/1995 Nagai ..... F25B 49/025 318/801
2006/0080989 A1* 4/2006 Aoki ..... F25B 13/00 62/324.4

FOREIGN PATENT DOCUMENTS

EP 2 924 375 A1 9/2015
JP H0359368 A * 3/1991
(Continued)

OTHER PUBLICATIONS

Matsuzaka, Heat Pump Device, Mar. 14, 1991, JPH0359368A, Whole Document.*
(Continued)

*Primary Examiner* — Larry Furdge
(74) *Attorney, Agent, or Firm* — Global IP Counselors, LLP

(57) ABSTRACT

A refrigeration apparatus includes a compressor, first and second heat exchangers, first and second electric valves, a passage-switching valve, a supercooling heat exchanger, and a controller. The first and second valves are disposed in first and second refrigerant passages. The supercooling heat exchanger conducts heat exchange between refrigerant flowing through the first and second refrigerant passages. The controller transitions to a defrosting operation mode upon determining that frost has formed on the second heat exchanger during a heating operation mode. The controller executes a defrosting preparatory control and a defrosting control after the defrosting preparatory control during the defrosting operation mode. The controller switches the passage-switching valve during the defrosting control. The controller narrows the opening degree of the first electric valve and controls the opening degree of the second electric valve to a minimum opening degree during the defrosting preparatory control.

20 Claims, 4 Drawing Sheets

(51) Int. Cl.
*F25B 47/02* (2006.01)
*F25B 25/00* (2006.01)
*F25B 49/02* (2006.01)

(52) U.S. Cl.
CPC ..... *F25B 49/025* (2013.01); *F25B 2313/003* (2013.01); *F25B 2313/0292* (2013.01); *F25B 2313/0294* (2013.01); *F25B 2313/02741* (2013.01); *F25B 2313/0314* (2013.01); *F25B 2313/0315* (2013.01); *F25B 2400/13* (2013.01); *F25B 2600/2509* (2013.01); *F25B 2600/2513* (2013.01)

(56) References Cited

FOREIGN PATENT DOCUMENTS

| | | | | |
|---|---|---|---|---|
| JP | 2003240391 | A | * | 8/2003 |
| JP | 2011179697 | A | * | 9/2011 |
| JP | 2014-105891 | A | | 6/2014 |

OTHER PUBLICATIONS

Aoyama et al., Refrigerating Cycle Device and Water Heating/Cooling Device, Sep. 15, 2011, JP2011179697A, Whole Document.*

Baba et al., Air Conditioner, Aug. 27, 2003, JP2003240391A, Whole Document.*

* cited by examiner

REFRIGERATION APPARATUS

TECHNICAL FIELD

The present invention relates to a refrigeration apparatus.

BACKGROUND ART

In the past, there have been refrigeration apparatuses for performing a vapor-compression refrigeration cycle, the refrigeration apparatuses performing a defrosting operation for eliminating frost adhering to an evaporator in circumstances such as winter or cold regions. For example, in the refrigeration apparatus disclosed in Japanese Laid-open Patent Application No. 2014-105891, when frost has formed on a second heat exchanger (an evaporator) during a heating operation for heating water by heat exchange between refrigerant and water in a first heat exchanger (a radiator), a defrosting operation is performed in which high-pressure gas refrigerant (hot gas) is sent to the second heat exchanger by switching the state of a four-way switching valve, and the frost is eliminated.

In Japanese Laid-open Patent Application No. 2014-105891, to shorten the time associated with the defrosting operation, before the defrosting operation is begun a heat storage operation is performed in which refrigerant enthalpy in the intake side of a compressor is increased while pressure loss in a refrigerant circuit is reduced by channeling refrigerant from a point midway through a refrigerant passage joining the first heat exchanger and the second heat exchanger, to a bypass passage allowing refrigerant to bypass to the intake side of the compressor, thereby increasing the amount of heat stored in the high-pressure side of the refrigeration cycle.

SUMMARY

Technical Problem

However, in Japanese Laid-open Patent Application No. 2014-105891, depending on the conditions, there could be cases in which before the defrosting operation is begun, the amount of refrigerant being loaded in the first heat exchanger (the radiator) falls below the proper value in the defrosting operation. In such cases, during the defrosting operation, water freezes as the evaporation pressure decreases in the first heat exchanger which is functioning as an evaporator of refrigerant, the refrigeration cycle would thereby be performed unsatisfactory, and it could be difficult to shorten the time associated with the defrosting operation.

In view of this, an object of the present invention is to provide a refrigeration apparatus for facilitating a shortening of the time associated with the defrosting operation.

Solution to Problem

A refrigeration apparatus according to a first aspect of the present invention comprises a compressor, a first heat exchanger, a second heat exchanger, a first electric valve, a passage-switching valve, a second electric valve, a supercooling heat exchanger, and a controller. The compressor is configured and arranged to compress refrigerant. The first heat exchanger is configured and arranged to conduct heat exchange between refrigerant and water. The second heat exchanger is configured and arranged to conduct heat exchange between refrigerant and an air flow. The first electric valve is placed in a first refrigerant passage. The first refrigerant passage extends between the first heat exchanger and the second heat exchanger. The first refrigerant passage is a passage for liquid refrigerant. The first electric valve is configured and arranged to depressurize refrigerant in accordance with the opening degree. The passage-switching valve constitutes a refrigerant circuit together with the compressor, the first heat exchanger, the second heat exchanger, and the first electric valve. The passage-switching valve is configured and arranged to switch the direction in which refrigerant flows in accordance with operating conditions. The second electric valve is placed in a second refrigerant passage. The second refrigerant passage branches from the first refrigerant passage and extends to an intake side of the compressor. The second electric valve is configured and arranged to depressurize or block refrigerant in accordance with the opening degree. The supercooling heat exchanger is placed in the first refrigerant passage and the second refrigerant passage. The supercooling heat exchanger is configured and arranged to conduct heat exchange between refrigerant flowing through the first refrigerant passage and refrigerant flowing through the second refrigerant passage. The controller is configured and arranged to control the actions of the compressor, the first electric valve, the passage-switching valve, and the second electric valve. The controller has a heating operation mode and a defrosting operation mode as operation modes. The controller controls the state of the passage-switching valve during the heating operation mode so as to make the first heat exchanger function as a radiator of refrigerant and the second heat exchanger function as an evaporator of refrigerant. The controller transitions to defrosting operation mode upon assessing during the heating operation mode that frost has formed on the second heat exchanger. The controller executes defrosting preparatory control and defrosting control during the defrosting operation mode. The controller executes the defrosting control after executing the defrosting preparatory control. The controller switches the state of the passage-switching valve during the defrosting control so as to make the first heat exchanger function as an evaporator of refrigerant and the second heat exchanger function as a radiator of refrigerant. The controller narrows the opening degree of the first electric valve during the defrosting preparatory control. The controller controls the opening degree of the second electric valve to a minimum opening degree during the defrosting preparatory control.

In the refrigeration apparatus according to the first aspect of the present invention, during defrosting operation mode, the controller executes defrosting preparatory control in which the opening degree of the first electric valve is narrowed and the opening degree of the second electric valve is controlled to a minimum opening degree, before executing defrosting control in which the state of the passage-switching valve is switched. Specifically, before the state of the passage-switching valve is switched (or in other words, before the defrosting operation starts) so that the first heat exchanger functions as an evaporator, the opening degree is narrowed in the first electric valve placed in the first refrigerant passage (the liquid refrigerant passage) extending between the first heat exchanger and the second heat exchanger, and the opening degree is controlled to a minimum opening degree in the second electric valve placed in the second refrigerant passage extending as a branch from the first refrigerant passage.

Due to this, when the controller has transitioned to defrosting operation mode (i.e., when it is assessed that frost has formed on the second heat exchanger), refrigerant is thereby readily sent to the first heat exchanger and readily accumulated in the first heat exchanger before defrosting control is executed (i.e., before the start of the defrosting operation in which the first heat exchanger functions as an evaporator). As a result, it is restrained that the amount of refrigerant loaded into the first heat exchanger functioning as an evaporator falls below the proper value when the defrosting operation starts. Therefore, the sudden decrease of refrigerant evaporation pressure in the first heat exchanger is suppressed during the defrosting operation. Along with this, it is restrained that the water in the first heat exchanger freeze as the refrigerant evaporation pressure decreases. Consequently, a satisfactory refrigeration cycle is readily achieved during the defrosting operation, and a shortening of the time needed for the defrosting operation is facilitated.

Here, the second electric valve is also controlled to a minimum opening degree in defrosting preparatory control, the term "minimum opening degree" in this case refers to the minimum opening degree of all opening degrees the second electric valve could be put to. Consequently, the "minimum opening degree" differs depending on the configurative aspect of the second electric valve. Specifically, when the second electric valve is configured so as to be capable of a fully closed state (a state of blocking the refrigerant passage), the "minimum opening degree" is a fully closed state. When the second electric valve is configured so that a very small opening degree is formed (i.e., a very small refrigerant passage is formed) when the second electric valve is in the minimum opening degree, the "minimum opening degree" is this very small opening degree.

Also, The proper value of the amount of refrigerant loaded into the first heat exchanger (the evaporator) when the defrosting operation starts is an amount of refrigerant at which there is no risk that the water will freeze due to the evaporation pressure of refrigerant in the first heat exchanger decreasing, and the proper value changes depending on the capacity, type, installation environment, and other features of the first heat exchanger.

A refrigeration apparatus according to a second aspect of the present invention is the refrigeration apparatus according to the first aspect, wherein the controller narrows the opening degree of the first electric valve during the defrosting preparatory control by setting the degree of superheat target value of the refrigerant in the intake side of the compressor to be greater than the value during the heating operation mode.

The opening degree of the first electric valve is thereby controlled in accordance with the degree of superheat of the refrigerant (i.e., in accordance with the state of the refrigerant in the refrigerant circuit). As a result, the opening degree of the first electric valve is controlled with high precision to the opening degree optimal for filling the first heat exchanger with refrigerant. Therefore, before the defrosting operation starts, refrigerant is readily sent from the second heat exchanger and the gas refrigerant passage to the first heat exchanger, and refrigerant is readily accumulated in the first heat exchanger. Consequently, it is restrained with high precision that the amount of refrigerant loaded into the first heat exchanger functioning as an evaporator falls below the proper value when the defrosting operation starts.

A refrigeration apparatus according to a third aspect of the present invention is the refrigeration apparatus according to the first or second aspect, wherein the controller alters a control constant used to control the first electric valve during the defrosting preparatory control.

When defrosting preparatory control is executed, the opening degree of the first electric valve is thereby quickly controlled to an opening degree optimal for filling the first heat exchanger with refrigerant. As a result, the amount of refrigerant equivalent to the proper value is quickly loaded into the first heat exchanger when defrosting preparatory control is executed. Consequently, the time needed to complete defrosting preparatory control is shortened, and the time needed to complete the process in defrosting operation mode (i.e., the defrosting operation) is shortened.

A refrigeration apparatus according to a fourth aspect of the present invention is the refrigeration apparatus according to any of the first through third aspects, wherein the controller causes the compressor to be driven at a maximum rotational speed during the defrosting preparatory control.

Refrigerant is thereby readily sent to the first heat exchanger before the defrosting operation starts. Consequently, it is further restrained that the amount of refrigerant loaded into the first heat exchanger functioning as an evaporator falls below the proper value when the defrosting operation starts.

A refrigeration apparatus according to a fifth aspect of the present invention is the refrigeration apparatus according to any of the first through fourth aspects, further comprising a fan. The fan is configured and arranged to generate the air flow that exchanges heat with the refrigerant in the second heat exchanger. The controller causes the fan to be driven at a maximum rotational speed during the defrosting preparatory control. The controller stops the fan during the defrosting control.

Due to the controller causing the fan to be driven at a maximum rotational speed during the defrosting preparatory control, refrigerant is even more readily sent to the first heat exchanger before the defrosting operation starts. Consequently, it is further restrained that the amount of refrigerant loaded into the first heat exchanger functioning as an evaporator falls below the proper value when the defrosting operation starts.

Due to the controller stopping the fan during the defrosting control, frost elimination on the second heat exchanger is facilitated during the defrosting operation.

A refrigeration apparatus according to a sixth aspect of the present invention is the refrigeration apparatus according to any of the first through fifth aspects, wherein the controller causes the compressor to be driven at a rotational speed lower than the maximum rotational speed during the defrosting control.

Due to this, the liquid-back phenomenon in which liquid refrigerant is drawn into the compressor is suppressed although the direction of refrigerant flow is switched by the state of passage-switching valve is being switched when the defrosting operation starts.

Advantageous Effects of Invention

In the refrigeration apparatus according to the first aspect of the present invention, it is restrained that the amount of refrigerant loaded into the first heat exchanger functioning as an evaporator falls below the proper value when the defrosting operation starts. Therefore, the sudden decrease of refrigerant evaporation pressure in the first heat exchanger is suppressed during the defrosting operation. Along with this, it is restrained that the water in the first heat exchanger freeze as the refrigerant evaporation pressure decreases. Consequently, a satisfactory refrigeration cycle is readily achieved during the defrosting operation, and a shortening of the time needed for the defrosting operation is facilitated.

In the refrigeration apparatus according to the second aspect of the present invention, it is restrained with high precision that the amount of refrigerant loaded into the first heat exchanger functioning as an evaporator falls below the proper value when the defrosting operation starts.

In the refrigeration apparatus according to the third aspect of the present invention, the time needed to complete defrosting preparatory control is shortened, and the time needed to complete the process in defrosting operation mode (i.e., the defrosting operation) is shortened.

In the refrigeration apparatus according to the fourth aspect of the present invention, it is further restrained that the amount of refrigerant loaded into the first heat exchanger functioning as an evaporator falls below the proper value when the defrosting operation starts.

In the refrigeration apparatus according to the fifth aspect of the present invention, it is further restrained that the amount of refrigerant loaded into the first heat exchanger functioning as an evaporator falls below the proper value when the defrosting operation starts. Also, frost elimination on the second heat exchanger is facilitated during the defrosting operation.

In the refrigeration apparatus according to the sixth aspect of the present invention, the liquid-back phenomenon in which liquid refrigerant is drawn into the compressor is suppressed when the defrosting operation starts.

DESCRIPTION OF EMBODIMENT

A hot water system 100 according to an embodiment of the present invention shall be described below with reference to the drawings. The following embodiment is a specific example of the present invention and is not intended to limit the technical range of the present invention, and this embodiment can be altered as appropriate within a range that does not deviate from the scope of the invention.

(1) Hot Water System 100

Figure 1:
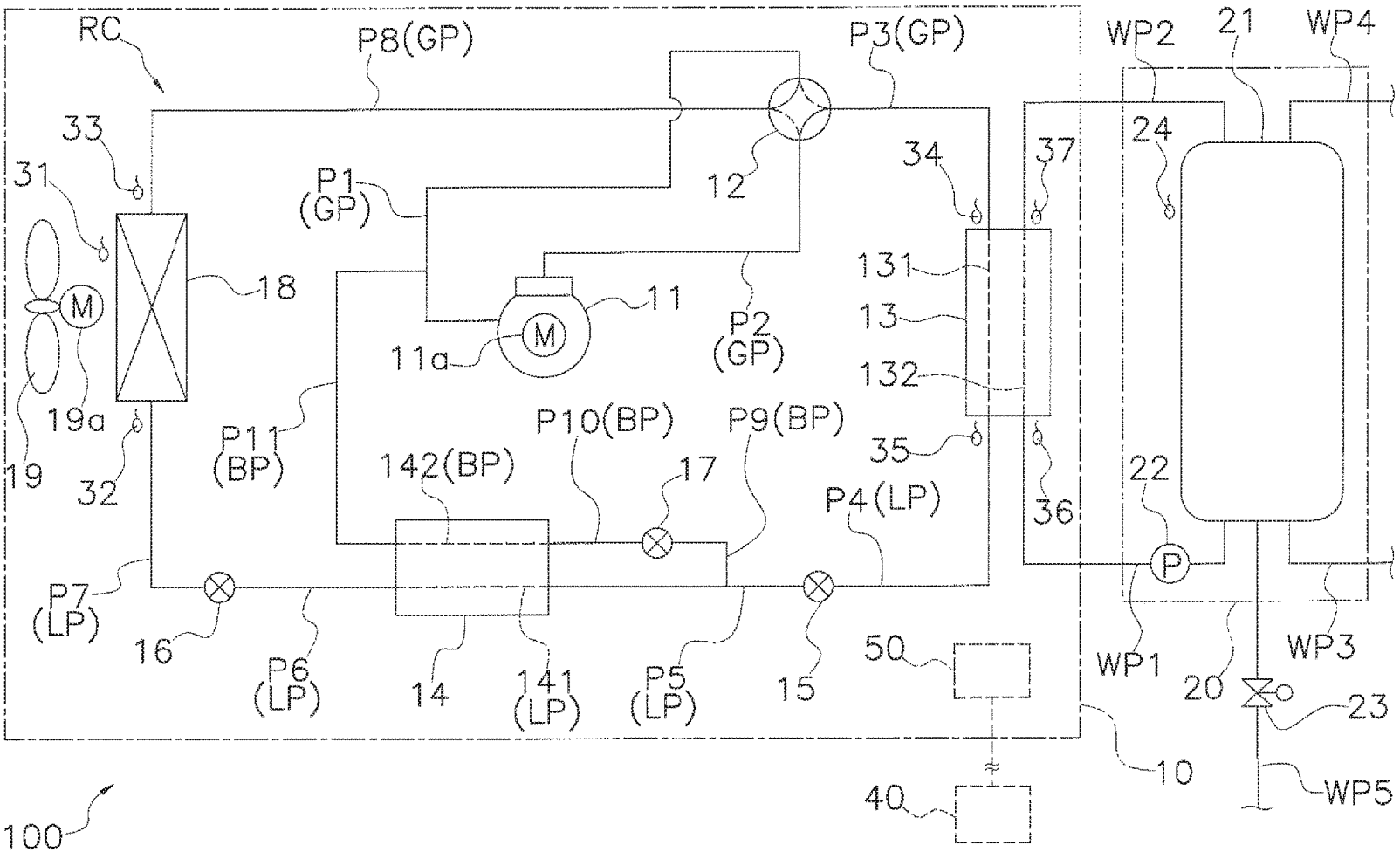
FIG. 1 is a schematic configuration drawing of a hot water system according to an embodiment of the present invention.

FIG. 1 is s schematic configuration drawing of the hot water system 100 according to an embodiment of the present invention.

The hot water system 100 is an apparatus for heating cold water to produce hot water. The operating state of the hot water system 100 is controlled by a controller 50 (described hereinafter).

The controller 50 of the hot water system 100 has operation modes such as a heating operation mode, a defrosting operation mode and the like.

In the hot water system 100, when the controller 50 transitions to the heating operation mode, a heating operation is performed in which heat is exchanged between water and a high-pressure refrigerant in a first heat exchanger 13 (described hereinafter), cold water is heated, and hot water is produced. The controller transitions to the heating operation mode when an operation start command is inputted by a user.

In the hot water system 100, when the controller 50 transitions to the defrosting operation mode, a defrosting operation is performed in which a high-pressure refrigerant (hot gas) is sent to a second heat exchanger 18 (described hereinafter), and frost adhering to the second heat exchanger 18 is eliminated. The controller 50 transitions to the defrosting operation mode when, during the heating operation mode, it is assessed by the controller 50 that frost has formed on the second heat exchanger 18 which is functioning as a heat-source-side heat exchanger (an evaporator).

The hot water system 100 has primarily a heat pump unit 10 including a refrigerant circuit RC, a water storage unit 20 including a water storage tank 21 for retaining cold water and hot water, and a remote controller 40 as an input device for the user to input commands. The heat pump unit 10 and the water storage unit 20 are connected by a first water pipe WP1 (described hereinafter) and a second water pipe WP2 (described hereinafter).

Heat Pump Unit 10

The heat pump unit 10 is installed on a rooftop, a veranda, or another location on the exterior of a building, or in a basement or the like.

The heat pump unit 10 has primarily a plurality of refrigerant pipes (first refrigerant pipe P1 to eleventh refrigerant pipe P11), a compressor 11, a four-way switching valve 12 (equivalent to the "passage-switching valve' in the Claims), the first heat exchanger 13, a supercooling heat exchanger 14, a first expansion valve 15, a second expansion valve 16 (equivalent to the "first electric valve" in the Claims), a third expansion valve 17 (equivalent to the "second electric valve" in the Claims), the second heat exchanger 18, a fan 19, a plurality of temperature sensors (first temperature sensor 31 to seventh temperature sensor 37), and the controller 50 in a heat pump unit casing (not shown) constituting the outer contours.

In the heat pump unit 10, the refrigerant circuit RC is configured by connecting the compressor 11, the four-way switching valve 12, the first heat exchanger 13, the supercooling heat exchanger 14, the first expansion valve 15, the second expansion valve 16, the third expansion valve 17, and the second heat exchanger 18 through the refrigerant pipes (P1 to P11). The heat pump unit 10 accommodates parts of the first water pipe WP1 and the second water pipe WP2 extending from the water storage unit 20, in the heat pump unit casing.

(1) Refrigerant Pipes (P1 to P11)

The first refrigerant pipe P1 is connected at one end to the four-way switching valve 12, and connected at the other end to the intake port of the compressor 11. The first refrigerant pipe P1 functions as an intake pipe of the compressor 11 during operation.

The second refrigerant pipe P2 is connected at one end to the discharge port of the compressor 11, and connected at the other end to the four-way switching valve 12. The second refrigerant pipe P2 functions as a discharge pipe of the compressor 11 during operation.

The third refrigerant pipe P3 is connected at one end to the four-way switching valve 12, and connected at the other end to the first heat exchanger 13. A fourth temperature sensor 34 for detecting the temperature (the usage-side gas refrigerant temperature $T_{GU}$) of refrigerant in the third refrigerant pipe P3 is thermally connected to the third refrigerant pipe P3.

The fourth refrigerant pipe P4 is connected at one end to the first heat exchanger 13, and connected at the other end to the first expansion valve 15. A fifth temperature sensor 35 for detecting the temperature (the usage-side liquid refrigerant temperature $T_{LU}$) of refrigerant in the fourth refrigerant pipe P4 is thermally connected to the fourth refrigerant pipe P4.

The fifth refrigerant pipe P5 is connected at one end to the first expansion valve 15, and connected at the other end to a first passage 141 of the supercooling heat exchanger 14.

The sixth refrigerant pipe P6 is connected at one end to the first passage 141 of the supercooling heat exchanger 14, and connected at the other end to the second expansion valve 16.

The seventh refrigerant pipe P7 is connected at one end to the second expansion valve 16, and connected at the other end to the second heat exchanger 18. The second temperature sensor 32 for detecting the temperature (the heat-source-side liquid refrigerant temperature $T_{LH}$) of refrigerant in the seventh refrigerant pipe P7 is thermally connected to the seventh refrigerant pipe P7.

The eighth refrigerant pipe P8 is connected at one end to the second heat exchanger 18, and connected at the other end to the four-way switching valve 12. A third temperature sensor 33 for detecting the temperature (the heat-source-side gas refrigerant temperature $T_{GH}$) of refrigerant in the eighth refrigerant pipe P8 is thermally connected to the eighth refrigerant pipe P8.

The ninth refrigerant pipe P9 is connected at one end to a point between the two ends of the fifth refrigerant pipe P5, and connected at the other end to the third expansion valve 17.

The tenth refrigerant pipe P10 is connected at one end to the third expansion valve 17, and connected at the other end to a second passage 142 of the supercooling heat exchanger 14.

The eleventh refrigerant pipe P11 is connected at one end to a second passage 142 of the supercooling heat exchanger 14, and connected at the other end to a point between the two ends of the first refrigerant pipe P1 (the intake pipe).

In the heat pump unit 10, a plurality of refrigerant passages are configured by these refrigerant pipes. Specifically, a gas refrigerant passage GP, a liquid refrigerant passage LP (equivalent to the "first refrigerant passage" in the Claims), and a bypass passage BP (equivalent to the "second refrigerant passage" in the Claims) are configured in the heat pump unit 10.

The gas refrigerant passage GP, which is a refrigerant passage through which primarily gas refrigerant flows, extends between the first heat exchanger 13 and the second heat exchanger 18. The gas refrigerant passage GP is configured primarily from the eighth refrigerant pipe P8, the first refrigerant pipe P1, the second refrigerant pipe P2, the third refrigerant pipe P3, and other components.

The liquid refrigerant passage LP, which is a refrigerant passage through which primarily liquid refrigerant flows, extends between the first heat exchanger 13 and the second heat exchanger 18. The liquid refrigerant passage LP is configured primarily from the fourth refrigerant pipe P4, the fifth refrigerant pipe P5, the first passage 141 (described hereinafter) of the supercooling heat exchanger 14, the sixth refrigerant pipe P6, the seventh refrigerant pipe P7, and other components.

The bypass passage BP is a refrigerant passage for allowing the refrigerant flowing through the liquid refrigerant passage LP to bypass to the intake side of the compressor 11. The bypass passage BP is a passage that branches from the liquid refrigerant passage LP (more specifically, from a point between the two ends of the fifth refrigerant pipe P5) and extends to the gas refrigerant passage GP (more specifically, to a point between the two ends of the first refrigerant pipe P1, i.e., the intake side of the compressor 11). The bypass passage BP is configured primarily from the ninth refrigerant pipe P9, the tenth refrigerant pipe P10, the second passage 142 of the supercooling heat exchanger 14, the eleventh refrigerant pipe P11, and other components.

(1) Elements (11 to 18) of Refrigerant Circuit RC

The compressor 11 is a mechanism for drawing in low-pressure gas refrigerant, compressing the refrigerant, and discharging the refrigerant. The compressor 11 has a sealed structure housing a compressor motor 11*a*. In the compressor 11, a rotary, scroll, or other type of compression element (not shown) accommodated in a casing (not shown) is driven with the compressor motor 11*a* as a drive source. During operation, the compressor 11 (the compressor motor 11*a*) is subjected to inverter control by the controller 50, and the rotational speed is adjusted depending on the conditions. Specifically, the capacity of the compressor 11 can be varied. When driven, the compressor 11 draws in low-pressure refrigerant through the intake port, compresses the refrigerant to high-pressure gas refrigerant, and then discharges the refrigerant through the discharge port.

The four-way switching valve 12 is a switching valve for switching the direction of refrigerant flow depending on the operating conditions. The four-way switching valve 12 switches the refrigerant passages by being supplied with a drive voltage by the controller 50. Specifically, the four-way switching valve 12 switches between a first state (refer to the solid lines of the four-way switching valve 12 in FIG. 1) in which the first refrigerant pipe P1 (the intake pipe) and the eighth refrigerant pipe P8 are connected and the second refrigerant pipe P2 (the discharge pipe) and the third refrigerant pipe P3 are connected, and a second state (refer to the dashed lines of the four-way switching valve 12 in FIG. 1) in which the first refrigerant pipe P1 and the third refrigerant pipe P3 are connected and the second refrigerant pipe P2 and the eighth refrigerant pipe P8 are connected.

The first heat exchanger 13 is a heat exchanger for conducting heat exchange between the refrigerant in the refrigerant circuit RC and cold water supplied from the water storage unit 20. The first heat exchanger 13 functions as a condenser or a radiator of the refrigerant (i.e., a heater of the cold water) during the heating operation mode (i.e., the heating operation), and functions as an evaporator of the refrigerant during the defrosting operation mode (i.e., the defrosting operation). The first heat exchanger 13 is a so-called plate-type heat exchanger, configured by superimposing pressed metal plates. The first heat exchanger 13 includes a first heat exchanger refrigerant passage 131 through which refrigerant passes and a first heat exchanger water passage 132 through which water passes, and has a structure for enabling heat exchange between the refrigerant passing through the first heat exchanger refrigerant passage 131 and the water passing through the first heat exchanger water passage 132. The gas-side end of the first heat exchanger refrigerant passage 131 is connected to the third refrigerant pipe P3, and the liquid-side end is connected to the fourth refrigerant pipe P4. The cold-water-side end of the first heat exchanger water passage 132 is connected to the first water pipe WP1, and the hot-water-side end is connected to the second water pipe WP2.

The supercooling heat exchanger 14 is a heat exchanger for conducting heat exchange between the refrigerant flowing through the liquid refrigerant passage LP and the refrigerant flowing through the bypass passage BP. More specifically, the supercooling heat exchanger 14 is a heat exchanger for bringing the refrigerant flowing through the liquid refrigerant passage LP to a supercooled state during the heating operation. The supercooling heat exchanger 14 is, e.g., a double-pipe type of heat exchanger. The supercooling heat exchanger 14 is placed in the liquid refrigerant passage LP and the bypass passage BP. More specifically, the supercooling heat exchanger 14 includes the first passage 141 constituting part of the liquid refrigerant passage LP and the second passage 142 constituting part of the bypass passage BP, and has a structure for enabling heat exchange between the refrigerant flowing through the first passage 141 and the refrigerant flowing through the second passage 142. One end of the first passage 141 is connected to the fifth refrigerant pipe P5, and the other end is connected to the sixth refrigerant pipe P6. One end of the second passage 142 is connected to the tenth refrigerant pipe P10, and the other end is connected to the eleventh refrigerant pipe P11.

The first expansion valve 15, the second expansion valve 16, and the third expansion valve 17 are electric valves of which the opening degrees are changed by the supply of a drive voltage.

One end of the first expansion valve 15 is connected to the fourth refrigerant pipe P4, and the other end is connected to the fifth refrigerant pipe P5. Specifically, the first expansion valve 15 is placed in the liquid refrigerant passage LP, between the first heat exchanger 13 and the supercooling heat exchanger 14.

One end of the second expansion valve 16 is connected to the sixth refrigerant pipe P6, and the other end is connected to the seventh refrigerant pipe P7. Specifically, the second expansion valve 16 is placed in the liquid refrigerant passage LP, between the supercooling heat exchanger 14 and the second heat exchanger 18.

One end of the third expansion valve 17 is connected to the ninth refrigerant pipe P9, and the other end is connected to the tenth refrigerant pipe P10. Specifically, the third expansion valve 17 is placed in the bypass passage BP, on the upstream side of the supercooling heat exchanger 14.

The first expansion valve 15, the second expansion valve 16, and the third expansion valve 17 function as expansion valves for reducing the pressure of refrigerant flowing in, in accordance with the opening degrees. The first expansion valve 15, the second expansion valve 16, and the third expansion valve 17 function as passage-blocking valves which become fully closed to block the refrigerant passages when controlled to the minimum opening degrees. The opening degrees of the first expansion valve 15, the second expansion valve 16, and the third expansion valve 17 are controlled (PI control or PID control) individually by the controller 50, and the opening degrees are appropriately adjusted in accordance with the operating conditions.

Specifically, during the heating operation mode (the heating operation), the opening degree of the second expansion valve 16 is decided in accordance with the degree of superheat target value $T_{SH}$ of the refrigerant flowing out from the evaporator (i.e., the second heat exchanger 18). For example, the second expansion valve 16 is controlled so that the opening degree decreases (narrows) in accordance with the degree of superheat target value $T_{SH}$ being set greater. During the heating operation mode (the heating operation), the opening degree of the third expansion valve 17 is decided in accordance with the degree of supercooling target value $T_{SC}$ of the refrigerant flowing out from the first passage 141 of the supercooling heat exchanger 14.

The second heat exchanger 18 is a heat exchanger for conducting heat exchange between the refrigerant in the refrigerant circuit RC and the air flow generated by the fan 19. The second heat exchanger 18 functions as an evaporator of refrigerant during the heating operation mode (i.e., the heating operation), and functions as a condenser (a radiator) of refrigerant during the defrosting operation mode (i.e., the defrosting operation). The second heat exchanger 18 is, e.g., a cross-fin-tube type heat exchanger, including a plurality of heat transfer tubes and a plurality of fins (not shown). The second heat exchanger 18 has a structure that enables heat exchange between the refrigerant passing through the heat transfer tubes and the air flow generated by the fan 19. The first temperature sensor 31 for detecting the heat transfer tube temperature (the heat transfer tube temperature $T_H$) is thermally connected to the heat transfer tubes of the second heat exchanger 18.

(1) Fan 19

The fan 19 is an air blower for generating an air flow that flows into the heat pump unit 10 from the exterior, passes through the second heat exchanger 18, and then flows out of the heat pump unit 10. The fan 19 is, e.g., a propeller fan. The fan 19 is driven together with a fan motor 19*a*. The driving of the fan 19 (the fan motor 19*a*) is controlled and the rotational speed is appropriately adjusted by the controller 50.

(1) Temperature Sensors (31 to 37)

The heat pump unit 10 has, as temperature sensors, the first temperature sensor 31, the second temperature sensor 32, and so on up to the seventh temperature sensor 37. The temperature sensors (31 to 37) are configured from, e.g., thermistors, thermocouples, or the like. The temperature sensors, which are electrically connected with the controller 50, output signals equivalent to detection values to the controller 50.

The first temperature sensor 31, which is thermally connected to the heat transfer tubes in the second heat exchanger 18, detects the heat transfer tube temperature $T_H$, which is the temperature of the heat transfer tubes of the second heat exchanger 18.

The second temperature sensor 32, which is thermally connected to the seventh refrigerant pipe P7, detects the heat-source-side liquid refrigerant temperature $T_{LH}$, which is the temperature of the gas refrigerant passing through the seventh refrigerant pipe P7 (i.e., the refrigerant flowing into the second heat exchanger 18 during the heating operation).

The third temperature sensor 33, which is thermally connected to the eighth refrigerant pipe P8, detects the heat-source-side gas refrigerant temperature $T_{GH}$, which is the temperature of the refrigerant passing through the eighth refrigerant pipe P8 (i.e., the refrigerant flowing out from the second heat exchanger 18 during the heating operation).

The fourth temperature sensor 34, which is thermally connected to the third refrigerant pipe P3, detects the usage-side gas refrigerant temperature $T_{GU}$, which is the temperature of the refrigerant passing through the third refrigerant pipe P3 (i.e., the refrigerant flowing into the first heat exchanger refrigerant passage 131 during the heating operation).

The fifth temperature sensor 35, which is thermally connected to the fourth refrigerant pipe P4, detects the usage-side liquid refrigerant temperature $T_{LU}$, which is the temperature of the refrigerant passing through the fourth refrigerant pipe P4 (i.e., the refrigerant flowing out from the first heat exchanger refrigerant passage 131 during the heating operation).

The sixth temperature sensor 36, which is thermally connected to the first water pipe WP1, detects the cold water temperature $T_{CW}$, which is the temperature of the cold water passing through the first water pipe WP1 (i.e., the cold water flowing into the first heat exchanger water passage 132 during the heating operation).

The seventh temperature sensor 37, which is thermally connected to the second water pipe WP2, detects the hot water temperature $T_{HW}$, which is the temperature of the hot water passing through the second water pipe WP2 (i.e., the hot water flowing out from the first heat exchanger water passage 132 during the heating operation).

(1) Controller 50

The controller 50 is a functional part for controlling the actions of the actuators included in the hot water system 100. The controller 50 includes a microcomputer configured from a CPU, memory, and/or the like. The controller 50 is started up by a supply of a power source from a power source supply part (not shown). The controller 50 is electrically connected with the actuators, the temperature sensors (31 to 37), and a hot water storage amount detection sensor 24 (described hereinafter) included in the hot water system 100. The details of the controller 50 are described in the forthcoming section "(2) Details of Controller 50."

Water Storage Unit 20

The water storage unit 20 is installed on a rooftop, a veranda, or another location on the exterior of a building, or in a basement or the like. The water storage unit 20 primarily accommodates parts of the plurality of water pipes (first water pipe WP1 through fifth water pipe WP5), inside the water storage unit casing (not shown) constituting the outer contours. Inside the water storage unit casing, the water storage unit 20 has the water storage tank 21, a pump 22, an opening/closing valve 23, and the hot water storage amount detection sensor 24.

The first water pipe WP1, which is a pipe for feeding cold water from the water storage tank 21 to the heat pump unit 10 (the first heat exchanger water passage 132), extends between the water storage unit 20 and the heat pump unit 10. Specifically, the first water pipe WP1 is connected at one end to a cold water feed-out port (not shown) formed in the lower part of the water storage tank 21, and connected at the other end to the inflow side of the first heat exchanger water passage 132.

The second water pipe WP2, which is a pipe for feeding hot water from the heat pump unit 10 (the first heat exchanger water passage 132) to the water storage tank 21, extends between the water storage unit 20 and the heat pump unit 10. Specifically, the second water pipe WP2 is connected at one end to a hot water inflow port (not shown) formed in the upper part of the water storage tank 21, and connected at the other end to the outflow side of the first heat exchanger water passage 132.

The third water pipe WP3 is a pipe for supplying cold water from the water storage tank 21 to the user. The third water pipe WP3 is connected to a cold water supply port (not shown) formed in the lower part of the water storage tank 21.

The fourth water pipe WP4 is a pipe for supplying hot water from the water storage tank 21 to the user. The fourth water pipe WP4 is connected to a hot water supply port (not shown) formed in the upper part of the water storage tank 21.

The fifth water pipe WP5 is a pipe for supplying cold water from a commercial water pipe or the like to the water storage tank 21. The fifth water pipe WP5 is connected to a cold water inflow port (not shown) formed in the lower part of the water storage tank 21.

The water storage tank 21 is a tank for storing the cold water and the hot water. In the space inside the water storage tank 21, the cold water is stored in the lower space, and the hot water is stored in the upper space.

The pump 22 is a pump for feeding the cold water inside the water storage tank 21 to the first heat exchanger water passage 132. The pump 22 is electrically connected with the controller 50, and is driven by being supplied with a drive signal from the controller 50. When the pump 22 is driven, the cold water inside the water storage tank 21 is sent to the first heat exchanger water passage 132.

The opening/closing valve 23 is placed in the fifth water pipe WP5. The opening/closing valve 23 is an electromagnetic valve capable of switching between a fully open state and a fully closed state. When the opening/closing valve 23 is fully open, water is supplied from the fifth water pipe WP5 to the water storage tank 21, and when the opening/closing valve is fully closed, the supply of water from the fifth water pipe WP5 to the water storage tank 21 is blocked. The opening/closing valve 23 is electrically connected with the controller 50, and the opening and closing thereof is controlled by the controller 50 in accordance with the amount of hot water stored and other factors.

The hot water storage amount detection sensor 24 is a sensor for detecting the amount of hot water (the amount of hot water stored) in the water storage tank 21. The hot water storage amount detection sensor 24 is placed in a predetermined position in the water storage tank 21. The hot water storage amount detection sensor 24, which is electrically connected with the controller 50, appropriately outputs a signal corresponding to the amount of hot water stored to the controller 50 at a predetermined timing.

Remote Controller 40

The remote controller 40 is an input device for inputting to the hot water system 100 various commands for setting the starting and stopping of the (heating) operation of the hot water system 100, the set temperature, the target amount of hot water stored, and/or other parameters. The remote controller 40 includes physical keys and/or a touch panel for inputting the various commands.

The remote controller 40 is a so-called wired remote control device, and is electrically connected to the controller 50 via a cable. The remote controller 40 conducts the sending and receiving of signals to and from the controller 50 in accordance with the conditions.

(2) Details of Controller 50

Figure 2:
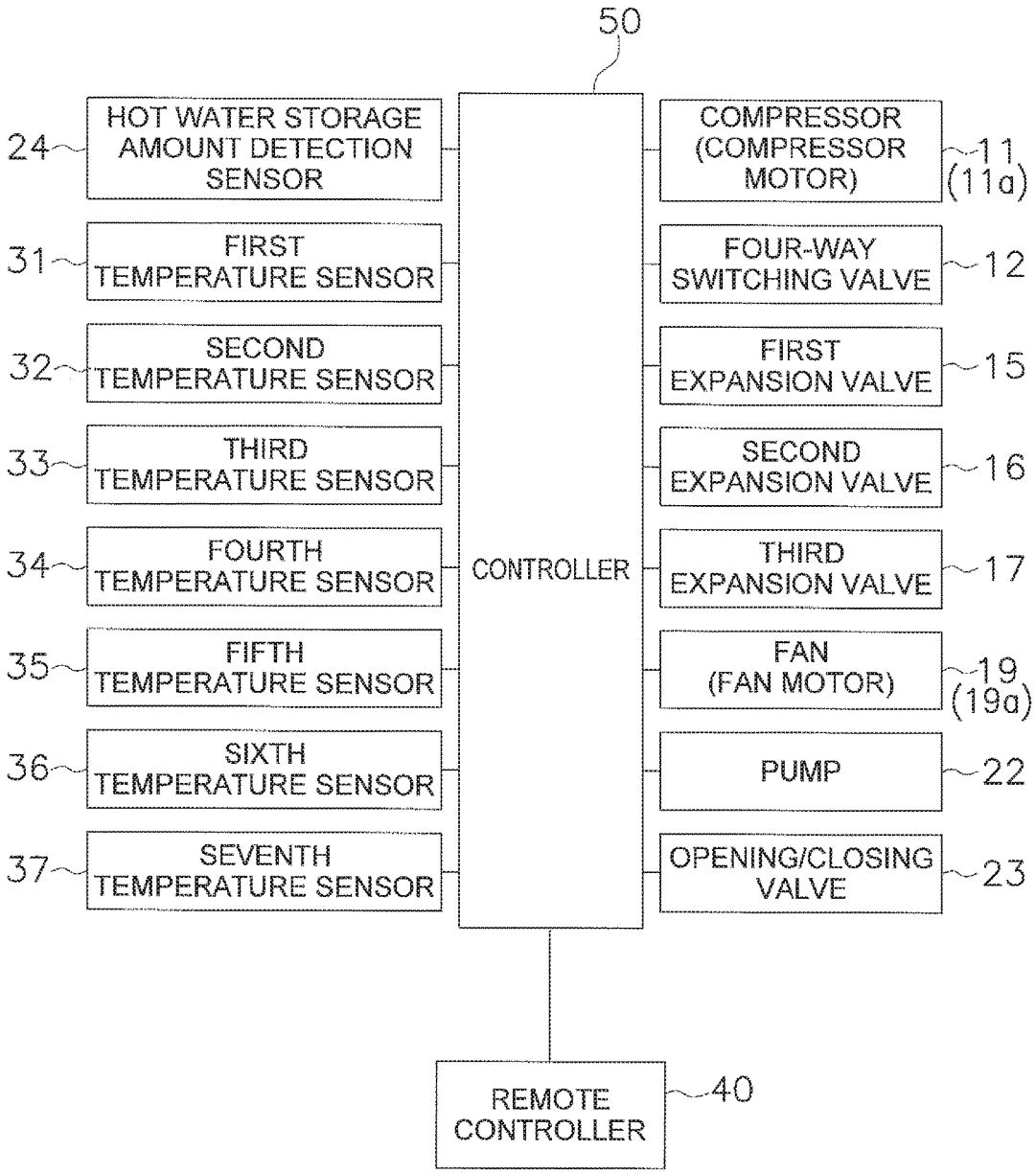
FIG. 2 is a block diagram showing a controller and various components connected to the controller.

FIG. 2 is a block diagram showing the controller 50 and various components connected to the controller 50.

In the hot water system 100, the controller 50 is electrically connected with the remote controller 40 via a communication cable. The controller 50 is also electrically connected with the plurality of actuators and the plurality of sensors via predetermined wires.

Specifically, the controller 50 is electrically connected with the compressor 11 (the compressor motor 11*a*), the four-way switching valve 12, the first expansion valve 15, the second expansion valve 16, the third expansion valve 17, the fan 19 (the fan motor 19*a*), the pump 22, the opening/closing valve 23, and other actuators, and the controller 50 performs control of the actuators individually in accordance with the conditions. The controller 50 is also electrically connected with the hot water storage amount detection sensor 24, the first temperature sensor 31, the second temperature sensor 32, and so on up to the seventh temperature sensor 37, and other sensors, and the controller 50 receives and retains signals outputted from the sensors at predetermined timings.

The controller 50 includes a storage area (not shown) configured from ROM and the like. Stored in this storage area are control programs in which the control specifics in each of the operation modes are described. The controller 50 performs control on the basis of the control programs when a power source is applied. The control specifics of the operation modes are described below.

(2-1) Standby Mode

The controller 50 enters standby mode according to a control program when a power source is applied. During standby mode, the controller 50 is in a standby state until an operation start command is inputted via the remote controller 40. During standby mode, the controller 50 transitions to heating operation mode when an operation start command is inputted by the user via the remote controller 40.

(2-2) Heating Operation Mode

During heating operation mode, the controller 50 controls the actuators in the following manner in accordance with the set temperature, the amount of hot water stored, and other factors. The heating operation is thereby performed in the hot water system 100, in which hot water is produced and hot water is stored.

Specifically, the controller 50 controls the four-way switching valve 12 to the first state (the state indicated by the solid lines of the four-way switching valve 12 in FIG. 1) so that the first heat exchanger 13 functions as a condenser (radiator) of refrigerant and the second heat exchanger 18 functions as an evaporator of refrigerant.

The controller 50 causes the compressor 11 to be driven at a rotational speed calculated on the basis of the control program. The rotational speed of the compressor 11 is appropriately calculated on the basis of the set temperature, the usage-side gas refrigerant temperature $T_{GU}$, the usage-side liquid refrigerant temperature $T_{LU}$, the cold water temperature $T_{CW}$, the hot water temperature $T_{HW}$, and other factors.

The controller 50 controls the first expansion valve 15 so that the opening degree reaches the maximum opening degree (the fully open state).

The controller 50 appropriately adjusts the opening degree of the second expansion valve 16 in order to make the second expansion valve 16 function as an expansion valve for depressurizing the refrigerant passing through the liquid refrigerant passage LP. More specifically, the controller 50 appropriately adjusts the opening degree of the second expansion valve 16 in accordance with the degree of superheat target value $T_{SH}$ and other factors. The degree of superheat target value $T_{SH}$ in heating operation mode is a value which is defined in advance in accordance with the set temperature, the cold water temperature $T_{CW}$, the heat-source-side gas refrigerant temperature $T_{GH}$, the heat-source-side liquid refrigerant temperature $T_{LH}$, and other factors, and which is described in the control program.

The controller 50 appropriately adjusts the opening degree of the third expansion valve 17 in accordance with the degree of supercooling target value $T_{SC}$ and other factors, in order to make the third expansion valve 17 function as an expansion valve for depressurizing the refrigerant flowing through the bypass passage BP. The degree of supercooling target value $T_{SC}$ is a value which is defined in advance in accordance with the set temperature, the cold water temperature $T_{CW}$, the usage-side gas refrigerant temperature $T_{GU}$, the usage-side liquid refrigerant temperature $T_{LU}$, and other factors, and which is described in the control program.

The controller 50 causes the fan 19 to be driven at a rotational speed defined according to the control program. The rotational speed of the fan 19 is defined in accordance with the degree of superheat target value $T_{SH}$ and other factors.

The controller 50 controls the starting/stopping and the rotational speed of the pump 22 in accordance with the amount of hot water stored, the cold water temperature $T_{CW}$, the hot water temperature $T_{HW}$, and other factors.

The controller 50 controls the opening and closing of the opening/closing valve 23 in accordance with the amount of hot water stored and other factors during heating operation mode.

The controller 50 transitions to defrosting operation mode when it is assessed that frost has formed on the second heat exchanger 18 during heating operation mode (the heating operation). Whether or not frost has formed on the second heat exchanger 18 is detected by, e.g., whether or not the heat transfer tube temperature $T_H$, which is the temperature of the heat transfer tubes of the second heat exchanger 18, is equal to or greater than a predetermined threshold. The method of determining whether or not frost has formed on the second heat exchanger 18 is not necessarily limited to this method, and another conventional method may be used.

(2-3) Defrosting Operation Mode

Upon transitioning to defrosting operation mode, the controller 50 first executes defrosting preparatory control, and executes defrosting control after defrosting preparatory control is completed.

(2-3-1) Defrosting Preparatory Control

When executing defrosting preparatory control, the controller 50 sets the degree of superheat target value $T_{SH}$ to be greater than the value during heating operation mode, according to the control program. Specifically, in defrosting preparatory control, the degree of superheat target value $T_{SH}$ is set to twice the value during heating operation mode. For example, when the degree of superheat target value $T_{SH}$ during heating operation mode had been set to 2 (° C.), the degree of superheat target value $T_{SH}$ is set to 4 (° C.) in defrosting preparatory control.

The controller 50 controls the actuators in the following manner in defrosting preparatory control.

Similar to heating operation mode, the controller 50 controls the four-way switching valve 12 to the first state (the state indicated by the solid lines of the four-way switching valve 12 in FIG. 1) so that the first heat exchanger 13 functions as a condenser (radiator) of refrigerant and the second heat exchanger 18 functions as an evaporator of refrigerant.

Until a predetermined time t1 has elapsed after the start of defrosting preparatory control, the controller 50 causes the compressor 11 to be driven at an upper limit rotational speed (the maximum rotational speed) defined in the control program. Specifically, the rotational speed of the compressor 11 is switched so as to be greater than the speed during heating operation mode, depending on the case. The purpose of controlling the rotational speed of the compressor 11 to the upper limit rotational speed in defrosting preparatory control in this manner is to ensure that a large amount of refrigerant is sent from the second heat exchanger 18 and the gas refrigerant passage GP to the first heat exchanger 13 before the defrosting operation starts.

When the controller 50 assesses that the predetermined time t1 has elapsed after the start of defrosting preparatory control, the controller 50 causes the rotational speed of the compressor 11 to decrease. Specifically, in this control, the controller 50 causes the compressor 11 to be driven at a rotational speed equivalent to 30 percent of the upper limit rotational speed (the maximum rotational speed) defined in the control program. The purpose of reducing the rotational speed of the compressor 11 in this manner after the predetermined time t1 has elapsed after the start of defrosting preparatory control is to suppress the liquid-back phenomenon in which liquid refrigerant is drawn into the compressor 11, when the defrosting operation starts.

The predetermined time t1 is defined in advance in the control program in accordance with design specifications, the installation environment, and/or other factors. In the present embodiment, the predetermined time t1 is set to two minutes.

The controller 50 controls the first expansion valve 15 so that the opening degree reaches the maximum opening degree (the fully open state), similar to heating operation mode.

The controller 50 appropriately adjusts the opening degree of the second expansion valve 16 in accordance with the degree of superheat target value $T_{SH}$ and other factors. When defrosting preparatory control is executed, along with the degree of superheat target value $T_{SH}$ being set greater than the value during heating operation mode as described above, the second expansion valve 16 is controlled so that the opening degree is smaller than the degree during heating operation mode. Specifically, in defrosting preparatory control, the controller 50 controls the opening degree of the second expansion valve 16 to be smaller than the degree during heating operation mode. As a result, when defrosting preparatory control is executed, refrigerant is readily sent into the first heat exchanger 13 (the first heat exchanger refrigerant passage 131), and the amount of refrigerant loaded into the first heat exchanger 13 is greater than the amount during heating operation mode.

The purpose of setting the degree of superheat target value $T_{SH}$ to be greater than the value during heating operation mode and reducing the opening degree of the second expansion valve 16 in this manner in defrosting preparatory control is to reduce the flow rate of refrigerant flowing through the liquid refrigerant passage LP, and to increase the amount of refrigerant loaded into the first heat exchanger 13 (the first heat exchanger refrigerant passage 131) above the amount during heating operation mode, before the start of the defrosting operation.

When defrosting preparatory control is executed, a control constant (integral gain) in the calculating formula used to decide the manipulated variable is altered so as to increase in the opening degree control (PI control or PID control) of the second expansion valve 16. The purpose of this is to increase the rapidity (responsiveness) of the second expansion valve 16 in response to the command from the controller 50 compared to heating operation mode, and to shorten the time needed for the first heat exchanger 13 to be filled with refrigerant, in defrosting preparatory control. Specifically, in defrosting preparatory control, the controller 50 increases the rapidity of the second expansion valve 16 to be greater than that during heating operation mode by altering the control constant used to control the second expansion valve 16.

The controller 50 controls the third expansion valve 17 so that the opening degree reaches the minimum opening degree. Specifically, the third expansion valve 17 is controlled to the fully closed state. As a result, when defrosting preparatory control is executed, the bypass passage BP is blocked unlike during heating operation mode. The purpose of the third expansion valve 17 being controlled to the minimum opening degree in this manner during defrosting preparatory control is to reduce the flow rate of refrigerant flowing through the bypass passage BP, and to increase the amount of refrigerant loaded into the first heat exchanger 13 (the first heat exchanger refrigerant passage 131) above the amount during heating operation mode, before the defrosting operation starts.

The controller 50 causes the fan 19 to be driven at an upper limit rotational speed (maximum rotational speed) defined in keeping with the control program. Specifically, the rotational speed of the fan 19 is switched so as to be greater than the speed during heating operation mode, depending on the case. The purpose of controlling the rotational speed of the fan 19 to the upper limit rotational speed in this manner in defrosting preparatory control is to increase the degree of superheat of the refrigerant flowing out from the second heat exchanger 18, and to ensure a high flow rate of refrigerant sent from the second heat exchanger 18 and the gas refrigerant passage GP to the first heat exchanger 13, before the defrosting operation starts.

The controller 50 controls the rotational speed of the pump 22 to a predetermined rotational speed. The controller 50 controls the opening and closing of the opening/closing valve 23 in accordance with the amount of hot water stored and other factors.

When a predetermined time t2 has elapsed after the start of defrosting preparatory control, the controller 50 assesses that defrosting preparatory control is completed, and executes defrosting control. The predetermined time t2 is defined in advance in the control program in accordance with design specifications, the installation environment, and/or other factors. In the present embodiment, the predetermined time t2 is set to three minutes.

(2-3-2) Defrosting Control

The controller 50 controls the actuators in the following manner in defrosting control.

The controller 50 controls the four-way switching valve 12 to the second state (the state indicated by the dashed lines of the four-way switching valve 12 in FIG. 1) so that the first heat exchanger 13 functions as an evaporator of refrigerant and the second heat exchanger 18 functions as a condenser (radiator) of refrigerant. As a result, when defrosting control is executed, the direction of refrigerant flow in the refrigerant circuit RC is the opposite of the direction during heating operation mode.

The controller 50 causes the compressor 11 to be driven at the same rotational speed as the speed when defrosting preparatory control is completed (i.e., a rotational speed equivalent to 30 percent of the upper limit rotational speed).

The controller 50 appropriately adjusts the opening degree of the first expansion valve 15 in accordance with the degree of superheat target value $T_{SH}$ (of the refrigerant flowing out from the first heat exchanger 13) and other factors, in order to make the first expansion valve 15 function as an expansion valve for depressurizing the refrigerant passing through the liquid refrigerant passage LP. The degree of superheat target value $T_{SH}$ during execution of defrosting control is a value defined in advance in accordance with the heat transfer tube temperature $T_H$, the usage-side gas refrigerant temperature $T_{GU}$, the usage-side liquid refrigerant temperature $T_{LU}$, and other factors, and is described in the control program.

The controller 50 controls the opening degrees of the second expansion valve 16 and the third expansion valve 17 to the maximum opening degrees. The controller 50 stops the driving of the fan 19. The controller 50 controls the rotational speed of the pump 22 to a predetermined rotational speed. The controller 50 controls the opening and closing of the opening/closing valve 23 in accordance with the amount of hot water stored and other factors.

After beginning to execute defrosting control (i.e., after the start of the defrosting operation), when the controller 50 assesses that frost elimination on the second heat exchanger 18 is completed, the controller completes defrosting control and transitions to heating operation mode. Whether or not frost elimination on the second heat exchanger 18 is completed is detected by, e.g., whether or not the heat transfer tube temperature $T_H$, which is the temperature of the heat transfer tubes of the second heat exchanger 18, is equal to or greater than a predetermined threshold. The method of determining whether or not frost elimination on the second heat exchanger 18 is completed is not necessarily limited to this method, and another conventional method may be used.

(3) Flow of Control by Controller 50

Figure 3:
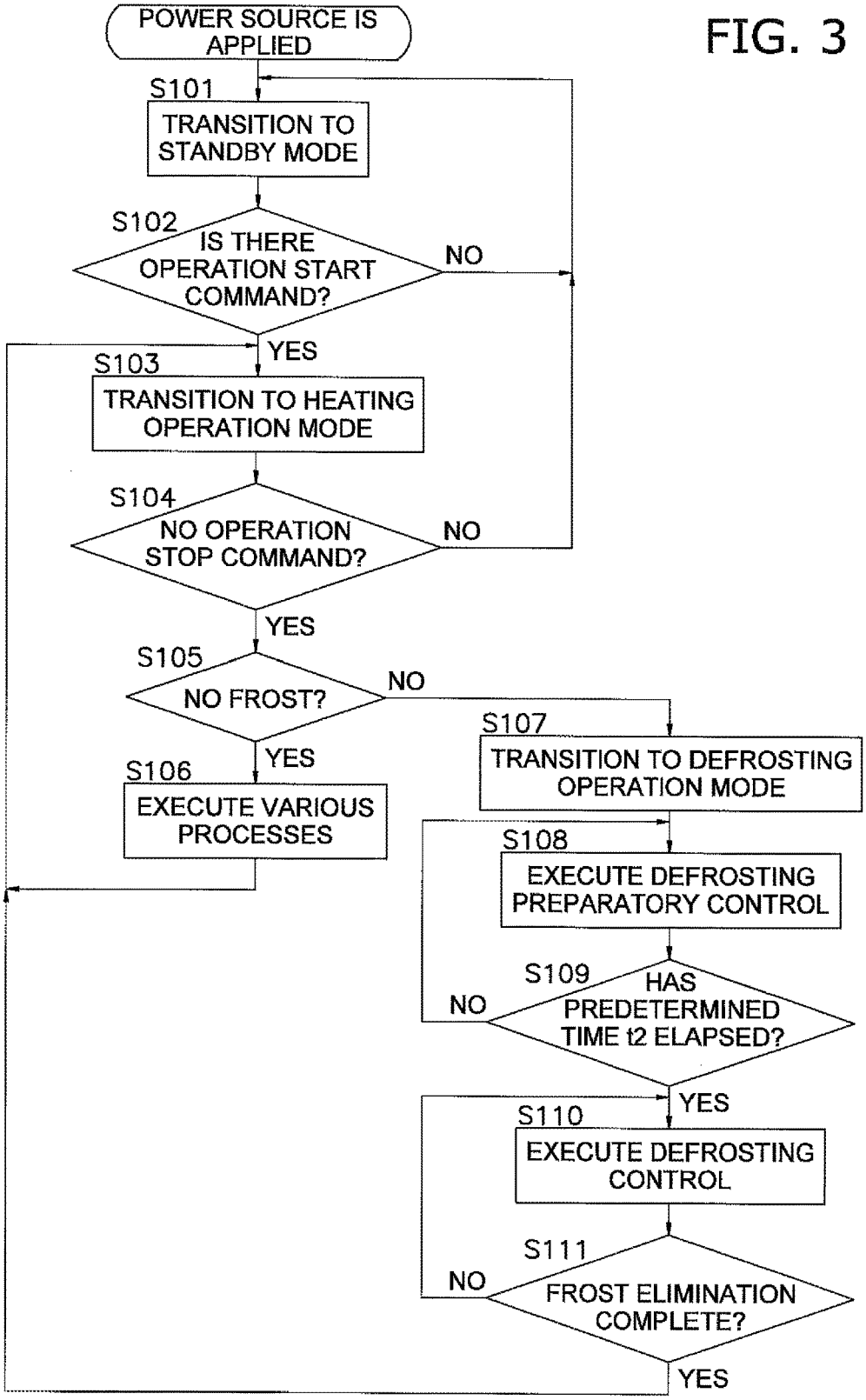
FIG. 3 is a flowchart showing an example of the control flow performed by the controller.

An example of the flow of control by the controller 50 is described below with reference to FIG. 3. FIG. 3 is a flowchart showing an example of the flow of control by the controller 50.

The controller 50 executes control with the following flow when a power source is applied.

In step S101, the controller 50 transitions to standby mode (or continues standby mode). The sequence then advances to step S102.

In step S102, the controller 50 determines whether or not an operation start command has been inputted. When the result of this determination is NO (i.e., when an operation start command has not been inputted), the sequence returns to step S101, and standby mode is continued. When the result of this determination is YES (i.e., when an operation start command has been inputted), the sequence advances to step S103.

In step S103, the controller 50 transitions to heating operation mode (or continues heating operation mode). The sequence then advances to step S104.

In step S104, the controller 50 determines whether or not an operation stop command has not been inputted. When the result of this determination is NO (i.e., when an operation stop command has been inputted), the sequence returns to step S101, and the controller transitions to standby mode. When the result of this determination is YES (i.e., when an operation stop command has not been inputted), the sequence advances to step S105.

In step S105, the controller 50 determines whether or not frost has not formed on the second heat exchanger 18. When the result of this determination is NO (i.e., when it is determined that frost has formed on the second heat exchanger 18), the sequence advances to step S107. When the result of this determination is YES (i.e., when it is determined that frost has not formed on the second heat exchanger 18, the sequence advances to step S106.

In step S106, the controller 50 executes various controls associated with heating operation mode, in keeping with the control program. The sequence then returns to step S103, and heating operation mode is continued.

In step S107, the controller 50 transitions to defrosting operation mode. The sequence then advances to step S108.

In step S108, the controller 50 executes various controls associated with defrosting preparatory control, in keeping with the control program. The sequence then advances to step S109.

In step S109, after beginning to execute defrosting preparatory control, the controller 50 determines whether or not the predetermined time t2 has elapsed. When the result of this determination is NO (i.e., when it is determined that the predetermined time t2 has not elapsed), the sequence returns to step S108, and execution of the various controls is continued. When the result of this determination is YES (i.e., when it is determined that the predetermined time t2 has elapsed), defrosting preparatory control is completed, and the sequence advances to step S110.

In step S110, the controller 50 executes various controls associated with defrosting control, in keeping with the control program. The sequence then advances to step S111.

In step S111, a determination is made as to whether or not frost elimination on the second heat exchanger 18 is completed. When the result of this determination is NO (i.e., when it is determined that frost elimination is not completed), the sequence returns to step S110, and execution of the various controls is continued. When the result of this determination is YES (i.e., when it is determined that frost elimination is completed), defrosting control is completed, the sequence returns to step S103, and the controller transitions to heating operation mode.

(4) Actions of Actuators

Figure 4:
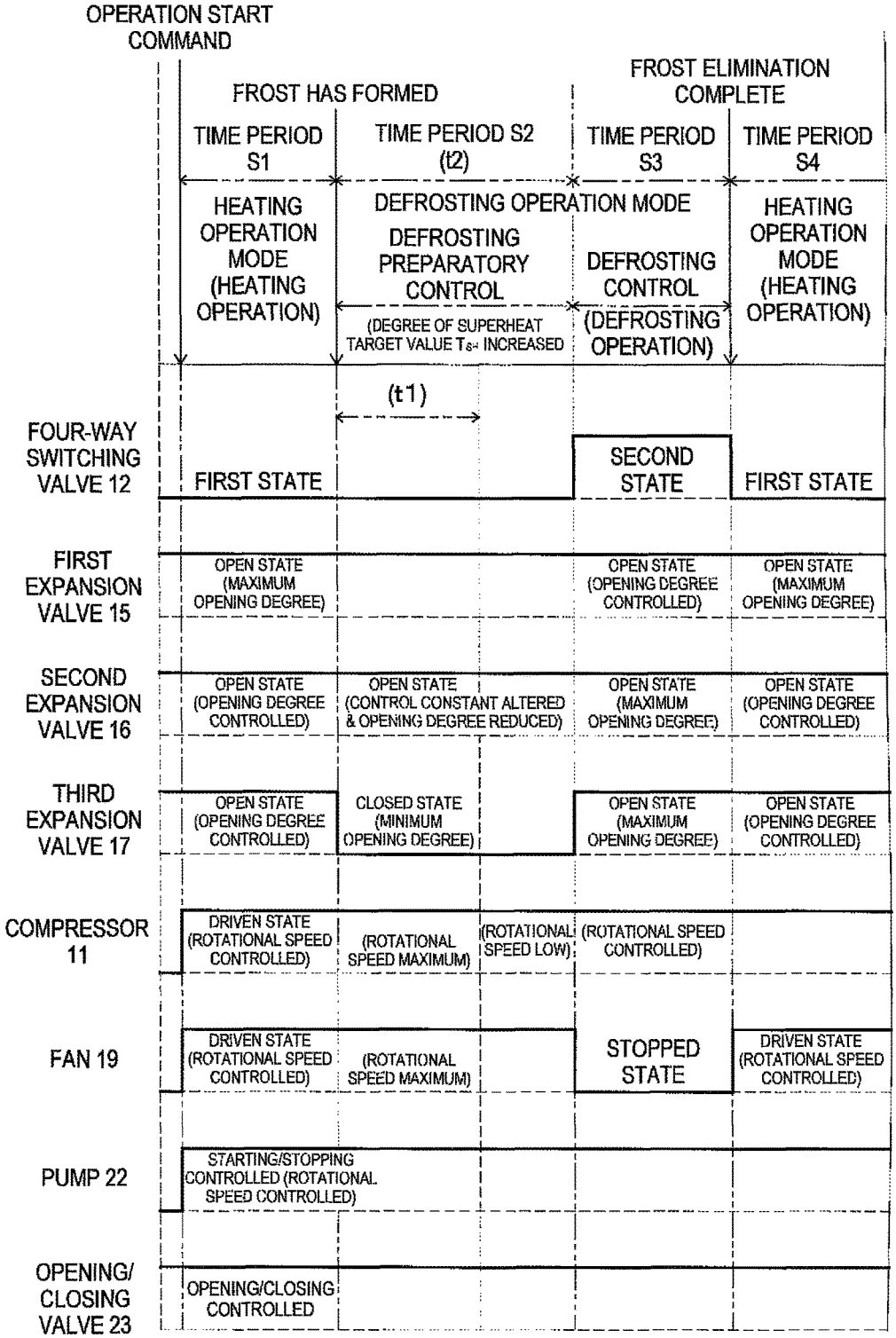
FIG. 4 is a timing chart showing an example of control of the actuators when an operation start command is inputted.

The actions of the actuators corresponding to the operating states are described below with reference to FIG. 4. FIG. 4 is a timing chart showing an example of the controls of the actuators when an operation start command is inputted.

When an operation start command is inputted to the hot water system 100, the actuators are controlled in, e.g., the following manner.

(4-1) Time Period S1

In the time period S1 (FIG. 4), the operation mode of the controller 50 transitions to heating operation mode in response to the input of the operation start command. As a result, the heating operation is performed in the hot water system 100.

Specifically, the four-way switching valve 12 is controlled to the first state (the state indicated by the solid lines of the four-way switching valve 12 in FIG. 1).

The first expansion valve 15 is controlled to the open state (a state in which the refrigerant passages are opened). Specifically, the first expansion valve 15 is controlled to the maximum opening degree.

The second expansion valve 16 is controlled to the open state, and the opening degree is controlled in accordance with the degree of superheat target value $T_{SH}$ and other factors.

The third expansion valve 17 is controlled to the open state, and the opening degree is controlled in accordance with the degree of supercooling target value $T_{SC}$ and other factors.

The compressor 11 is controlled to a driven state, and the rotational speed is adjusted on the basis of the set temperature, the usage-side gas refrigerant temperature $T_{GU}$, the usage-side liquid refrigerant temperature $T_{LU}$, the cold water temperature $T_{CW}$, the hot water temperature $T_{HW}$, and other factors.

The fan 19 is controlled to a driven state, and the rotational speed is adjusted in accordance with the degree of superheat target value $T_{SH}$ and other factors.

The starting and stopping of the pump 22 is controlled and the rotational speed thereof is adjusted in accordance with the amount of hot water stored, the cold water temperature $T_{CW}$, the hot water temperature $T_{HW}$, and other factors.

The opening and closing of the opening/closing valve 23 is controlled in accordance with the amount of hot water stored and other factors.

(4-2) Time Period S2

In the time period S2 (FIG. 4), in response to the assessment that frost has formed on the second heat exchanger 18, the operation mode of the controller 50 transitions to defrosting operation mode. As a result, defrosting preparatory control is executed.

Specifically, the degree of superheat target value $T_{SH}$ is set to be greater than the value during heating operation mode, as the control associated with defrosting preparatory control.

The four-way switching valve 12 is controlled to the first state, similar to the time period S1.

The first expansion valve 15 is controlled to an open state. Specifically, the first expansion valve 15 is also controlled to the maximum opening degree similar to the time period S1.

The second expansion valve 16 is controlled to the open state, and the opening degree is controlled in accordance with the degree of superheat target value $T_{SH}$ and other factors. More specifically, the second expansion valve 16 is controlled so that the opening degree is smaller than the degree during heating operation mode, along with the degree of superheat target value $T_{SH}$ being set greater than the degree during heating operation mode.

The third expansion valve 17 is controlled to a closed state (a state in which the refrigerant passages are blocked). Specifically, the third expansion valve 17 is controlled to the minimum opening degree.

The compressor 11 is controlled to a driven state, and the rotational speed is controlled to the upper limit rotational speed (the rotational speed maximum). After the predetermined time t1 has elapsed from the start of defrosting preparatory control, the rotational speed of the compressor 11 is adjusted so as to decrease from the upper limit rotational speed (more specifically, so as to reach a rotational speed equivalent to 30 percent of the upper limit rotational speed).

The fan 19 is controlled to a driven state, and the rotational speed is adjusted in accordance with the degree of superheat target value $T_{SH}$ and other factors. More specifically, along with the degree of superheat target value $T_{SH}$ being set greater than the value during heating operation mode, the rotational speed of the fan 19 is controlled to the upper limit rotational speed (the rotational speed maximum).

The starting and stopping of the pump 22 is controlled and the rotational speed thereof is adjusted in accordance with the amount of hot water stored, the cold water temperature $T_{CW}$, the hot water temperature $T_{HW}$, and other factors, similar to the time period S1.

The opening and closing of the opening/closing valve 23 is controlled in accordance with the amount of hot water stored and other factors, similar to the time period S1.

(4-3) Time Period S3

In the time period S3 (FIG. 4), defrosting preparatory control is completed and defrosting control is executed in response to the predetermined time t2 having elapsed since the start of defrosting preparatory control. As a result, the defrosting operation is performed in the hot water system 100.

Specifically, the four-way switching valve 12 is controlled to the second state (the state indicated by the dashed lines of the four-way switching valve 12 in FIG. 1) as the control associated with defrosting control.

The first expansion valve 15 is controlled to the open state, and the opening degree is controlled in accordance with the degree of superheat target value $T_{SH}$ and other factors.

The second expansion valve 16 is controlled to an open state, and is also controlled to the maximum opening degree.

The third expansion valve 17 is controlled to an open state, and is also controlled to the maximum opening degree.

The compressor 11 is controlled to a driven state, and the rotational speed is appropriately adjusted.

The fan 19 is controlled to a stopped state.

The starting and stopping of the pump 22 is controlled and the rotational speed thereof is adjusted appropriately.

The opening and closing of the opening/closing valve 23 is controlled appropriately.

(4-4) Time Period S4

In the time period S4 (FIG. 4), in response to the assessment that frost elimination on the second heat exchanger 18 is completed, defrosting control (the defrosting operation) is completed and the operation mode of the controller 50 transitions to heating operation mode. After a predetermined return control (not shown) has been executed, the actuators are thereby controlled to the same state as in the time period S1. As a result, the heating operation is performed in the hot water system 100.

(5) Flow of Refrigerant and Water in Hot Water System 100

(5-1) Flow of Refrigerant and Water During Heating Operation Mode (Heating Operation)

During heating operation mode (the heating operation), the four-way switching valve 12 is controlled to the first state (the state indicated by the solid lines of the four-way switching valve 12 in FIG. 1). The discharge port of the compressor 11 is thereby connected to the gas side of the first heat exchanger refrigerant passage 131 via the second refrigerant pipe P2 and the third refrigerant pipe P3, and the intake port of the compressor 11 is connected to the gas side of the second heat exchanger 18 via the first refrigerant pipe P1 and the eighth refrigerant pipe P8.

The first expansion valve 15 is controlled to the maximum opening degree (the fully open state). The opening degree of the second expansion valve 16 is appropriately adjusted in accordance with the degree of superheat target value $T_{SH}$ and other factors, and the second expansion valve 16 functions as an expansion valve for depressurizing the refrigerant flowing through the liquid refrigerant passage LP. The opening degree of the third expansion valve 17 is appropriately adjusted in accordance with the degree of supercooling target value $T_{SC}$ and other factors, and the third expansion valve 17 functions as an expansion valve for depressurizing the refrigerant flowing through the bypass passage BP. The opening and closing of the opening/closing valve 23 is controlled in accordance with the amount of hot water stored and other factors.

When the compressor 11, the fan 19, and the pump 22 reach driven states, refrigerant circulates within the refrigerant circuit RC and cold water is sent from the water storage tank 21 to the first heat exchanger water passage 132.

Specifically, the refrigerant in the refrigerant circuit RC circulates in the following manner.

Due to the compressor 11 reaching a driven state, low-pressure refrigerant in the first refrigerant pipe P1 is drawn into the compressor 11 via the intake port and compressed to high-pressure gas refrigerant, which is then discharged from the compressor 11 via the discharge port. The refrigerant discharged from the compressor 11 is sent to the first heat exchanger refrigerant passage 131 via the second refrigerant pipe P2, the four-way switching valve 12, and the third refrigerant pipe P3 (i.e., the gas refrigerant passage GP).

The refrigerant sent to the first heat exchanger refrigerant passage 131, when flowing through the first heat exchanger refrigerant passage 131, exchanges heat with the cold water flowing through the first heat exchanger water passage 132 and condenses to high-pressure liquid refrigerant. The specific enthalpy of the refrigerant decreases at this time.

The high-pressure liquid refrigerant flowing out from the first heat exchanger refrigerant passage 131 is sent to the fifth refrigerant pipe P5 via the fourth refrigerant pipe P4 and the first expansion valve 15. The refrigerant flowing through the fifth refrigerant pipe P5 branches in two paths midway through.

One refrigerant branched into two flows into the bypass passage BP and through the ninth refrigerant pipe P9 to the third expansion valve 17, where the refrigerant is depressurized depending on the opening degree. After passing through the third expansion valve 17, the refrigerant is sent to the second passage 142 of the supercooling heat exchanger 14 via the tenth refrigerant pipe P10. The refrigerant sent to the second passage 142, while passing through the second passage 142, is subjected to heat exchange with and heated by the refrigerant flowing through the first passage 141. After passing through the second passage 142, the refrigerant passes through the eleventh refrigerant pipe P11 and merges with low-pressure gas refrigerant flowing through the first refrigerant pipe P1.

The other refrigerant branched into two is sent to the first passage 141 of the supercooling heat exchanger 14. The refrigerant sent to the first passage 141, while flowing through the first passage 141, undergoes heat exchange with the refrigerant flowing through the second passage 142 and reaches a supercooled state, and this refrigerant is sent to the second expansion valve 16 via the sixth refrigerant pipe P6.

The refrigerant sent to the second expansion valve 16 is depressurized depending on the opening degree of the second expansion valve 16, becoming low-pressure gas-liquid two-phase refrigerant. After passing through the second expansion valve 16, the refrigerant is sent to the second heat exchanger 18 via the seventh refrigerant pipe P7. The refrigerant sent to the second heat exchanger 18, while flowing through the second heat exchanger 18, is subjected to heat exchange with and evaporated by the air flow generated by the fan 19, becoming low-pressure gas refrigerant. The specific enthalpy of the refrigerant increases at this time. After passing through the second heat exchanger 18, the gas refrigerant is drawn into the compressor 11 via the eighth refrigerant pipe P8, the four-way switching valve 12, and the first refrigerant pipe P1.

During the heating operation mode, the opening degrees of the second expansion valve 16 and the third expansion valve 17 and the rotational speed of the compressor 11 are appropriately adjusted, and there are both cases in which the refrigerant flowing through the refrigerant circuit RC circulates at a high rate and cases in which the refrigerant circulates at a low rate.

The cold water in the water storage tank 21 is sent to the first heat exchanger water passage 132 via the first water pipe WP1 by the driving of the pump 22. The cold water sent to the first heat exchanger water passage 132, while flowing through the first heat exchanger water passage 132, is heated by the refrigerant flowing through the first heat exchanger refrigerant passage 131, becoming hot water. The hot water flowing out from the first heat exchanger 13 is sent to the water storage tank 21 via the second water pipe WP2.

The starting and stopping and/or rotational speed of the pump 22 are appropriately adjusted by the controller 50 in accordance with the amount of hot water stored and other factors.

(5-2) Flow of Refrigerant and Water During Defrosting Preparatory Control in Defrosting Operation Mode When the operation mode transitions from heating operation mode to defrosting operation mode and defrosting preparatory control is executed by the controller 50, the four-way switching valve 12 is controlled so as to continue the first state (the state indicated by the solid lines of the four-way switching valve 12 in FIG. 1). Therefore, the direction in which refrigerant flows within the refrigerant circuit RC remains the same as the direction during heating operation mode (the heating operation).

When defrosting preparatory control is executed, the first expansion valve 15 is controlled to the maximum opening degree. The second expansion valve 16 is controlled so that the opening degree narrows. The third expansion valve 17 is controlled to the minimum opening degree (the fully closed state).

The compressor 11 is controlled to the upper limit rotational speed until the predetermined time t1 elapses, and after the predetermined time t1 elapses, the compressor is controlled to a rotational speed equivalent to 30 percent of the upper limit rotational speed. The fan 19 is controlled to the upper limit rotational speed. The pump 22 is controlled to a predetermined rotational speed.

When the actuators are controlled as described above by defrosting preparatory control, the refrigerant in the refrigerant circuit RC reaches the following state.

Specifically, due to the rotational speed of the compressor 11 being set to the upper limit rotational speed (the maximum rotational speed), a large amount of refrigerant is ensured to be sent from the gas refrigerant passage GP to the first heat exchanger 13. Specifically, the amount of refrigerant sent to the first heat exchanger 13 will likely be greater than the amount during heating operation mode.

Due to the rotational speed of the fan 19 being set to the upper limit rotational speed, a large amount of gas refrigerant is ensured to be sent from the second heat exchanger 18 to the gas refrigerant passage GP. Specifically, the amount of refrigerant sent to the first heat exchanger 13 will likely be greater than the amount during heating operation mode.

Along with the degree of superheat target value $T_{SH}$ being set greater than the value during heating operation mode and the opening degree of the second expansion valve 16 accordingly being reduced below the degree during heating operation mode, refrigerant is readily sent from the second heat exchanger 18 and the gas refrigerant passage GP to the first heat exchanger 13, and refrigerant is more readily accumulated in the first heat exchanger 13 side of the liquid refrigerant passage LP than in the second expansion valve 16. As a result, a greater amount of refrigerant is ensured to be loaded in the first heat exchanger 13 (the first heat exchanger refrigerant passage 131) than during heating operation mode.

Due to the third expansion valve 17 being controlled to the minimum opening degree (the fully closed state), the flow of refrigerant in the bypass passage BP (specifically, the refrigerant sent from the ninth refrigerant pipe P9 to the tenth refrigerant pipe P10) is blocked. Along with this, it becomes easy for refrigerant to accumulate in the liquid refrigerant passage LP and the first heat exchanger 13. As a result, a greater amount of refrigerant is ensured to be loaded in the first heat exchanger 13 (the first heat exchanger refrigerant passage 131) than during heating operation mode.

(5-3) Flow of Refrigerant and Water During Defrosting Control (During Defrosting Operation) in Defrosting Operation Mode When defrosting control is executed by the controller 50, the four-way switching valve 12 is controlled so as to switch to the second state (the state indicated by the dashed lines of the four-way switching valve 12 in FIG. 1). Therefore, the direction in which refrigerant flows within the refrigerant circuit RC is the opposite of the direction during heating operation mode (the heating operation). Specifically, when defrosting control is executed, unlike during heating operation mode, the first heat exchanger 13 functions as an evaporator of refrigerant and the second heat exchanger 18 functions as a condenser (radiator) of refrigerant.

The opening degree of the first expansion valve 15 is controlled, and the opening degree is appropriately adjusted. Specifically, the opening degree of the first expansion valve 15 is appropriately adjusted in accordance with the degree of superheat target value $T_{SH}$ (of the refrigerant in the first heat exchanger 13) so that gas refrigerant (hot gas) is properly sent to the second heat exchanger 18 via the gas refrigerant passage GP.

The second expansion valve 16 is controlled to the maximum opening degree. Specifically, the second expansion valve 16 is controlled so that the opening degree is greater than when defrosting preparatory control is executed. The opening degree of the third expansion valve 17 is appropriately adjusted in accordance with the degree of supercooling target value $T_{SC}$.

The rotational speed of the compressor 11 is controlled to a rotational speed equivalent to 30 percent of the upper limit rotational speed. Specifically, the compressor 11 is controlled so as to be driven at a lower rotational speed than the speed at the start of defrosting preparatory control (i.e., at the transition to defrosting operation mode).

The driving of the fan 19 is stopped. The other actuators are controlled so as to maintain roughly the same states as those during the completion of defrosting preparatory control.

When the actuators are controlled to the associated states (i.e., when the defrosting operation is started), the refrigerant in the refrigerant circuit RC circulates in the following manner.

The refrigerant loaded into the first heat exchanger 13 is drawn into the compressor 11 via the third refrigerant pipe P3, the four-way switching valve 12, and the first refrigerant pipe P1. At this time, the rotational speed of the compressor 11 is controlled to a rotational speed less than the upper limit rotational speed, therefore suppressing the liquid-back phenomenon in which liquid refrigerant is drawn into the compressor 11.

The refrigerant drawn into the compressor 11 is compressed to high-pressure gas refrigerant, and then discharged from the compressor 11 via the discharge port. The refrigerant discharged from the compressor 11 is sent to the second heat exchanger 18 via the second refrigerant pipe P2, the four-way switching valve 12, and the eighth refrigerant pipe P8 (i.e., the gas refrigerant passage GP).

The refrigerant sent to the second heat exchanger 18 exchanges heat with the frost adhering to the second heat exchanger 18, and condenses to high-pressure liquid refrigerant. At this time, the frost adhering to the second heat exchanger 18 is heated by the heat exchange with the gas refrigerant, and melts and evaporates upon reaching its melting point.

The high-pressure liquid refrigerant flowing out from the second heat exchanger 18 is sent to the first passage 141 of the supercooling heat exchanger 14 via the seventh refrigerant pipe P7, the second expansion valve 16 and the sixth refrigerant pipe P6. The refrigerant sent to the first passage 141, when flowing through the first passage 141, exchanges heat with the refrigerant flowing through the second passage 142, reaching a supercooled state and then being sent to the fifth refrigerant pipe P5. The refrigerant flowing through the fifth refrigerant pipe P5 branches in two paths midway through.

One refrigerant branched into two flows into the bypass passage BP and through the ninth refrigerant pipe P9 to the third expansion valve 17, where the refrigerant is depressurized depending on the opening degree. After passing through the third expansion valve 17, the refrigerant is sent to the second passage 142 of the supercooling heat exchanger 14 via the tenth refrigerant pipe P10. The refrigerant sent to the second passage 142, when flowing through the second passage 142, is subjected to heat exchange with and heated by the refrigerant flowing through the first passage 141, and is then passed through the eleventh refrigerant pipe P11 to merge with the low-pressure gas refrigerant flowing through the first refrigerant pipe P1.

The other refrigerant branched into two is sent to the first expansion valve 15. The refrigerant sent to the first expansion valve 15 is depressurized depending on the opening degree of the first expansion valve 15, becoming low-pressure gas-liquid two-phase refrigerant. After passing through the first expansion valve 15, the refrigerant is sent to the first heat exchanger refrigerant passage 131 via the fourth refrigerant pipe P4. The refrigerant sent to the first heat exchanger refrigerant passage 131, when flowing through the first heat exchanger refrigerant passage 131, is subjected to heat exchange with and evaporated by the water in the first heat exchanger water passage 132, becoming low-pressure gas refrigerant.

Before the start of defrosting control, due to defrosting preparatory control being executed, the amount of refrigerant loaded into the first heat exchanger 13 (the first heat exchanger refrigerant passage 131) is greater than the amount during the heating operation. Therefore, during the defrosting operation, the evaporation pressure of the refrigerant is greater than the pressure during the heating operation.

After passing through the first heat exchanger 13, the gas refrigerant is drawn into the compressor 11 via the third refrigerant pipe P3, the four-way switching valve 12, and the first refrigerant pipe P1.

(6) Function of Hot Water System 100

The hot water system 100 is configured so that defrosting preparatory control is executed before defrosting control is executed (before the start of the defrosting operation). Specifically, before the start of the defrosting operation, the opening degree of the second expansion valve 16 narrows and the opening degree of the third expansion valve 17 is controlled to the minimum opening degree. Specifically, before the state of the four-way switching valve 12 is switched so that the first heat exchanger 13 functions as an evaporator, the opening degree is narrowed in the second expansion valve 16 placed in the liquid refrigerant passage LP extending between the first heat exchanger 13 and the second heat exchanger 18, and the opening degree is controlled to the minimum opening degree in the third expansion valve 17 placed in the bypass passage BP extending as a branch from the liquid refrigerant passage LP.

Refrigerant is thereby readily send to the first heat exchanger 13 and readily accumulated before defrosting control is executed (i.e., before the start of the defrosting operation in which the first heat exchanger 13 functions as an evaporator). As a result, when defrosting control is executed (when the defrosting operation starts), the amount of refrigerant loaded into the first heat exchanger 13 functioning as an evaporator is kept from falling below the proper value (a refrigerant amount at which there is no risk that the evaporation pressure of refrigerant in the first heat exchanger refrigerant passage 131 will decrease and the water in the first heat exchanger water passage 132 will freeze).

Depending on the installation environment (e.g., temperature of outside air and the like), frost could form on the intake pipe of the compressor 11 (i.e., the first refrigerant pipe P1). Because the intake pipe of the compressor 11 corresponds to the side that is lower in pressure in the refrigeration cycle in both the heating operation and the defrosting operation, the frost formed on the intake pipe is not readily eliminated. However, defrosting preparatory control is performed in the hot water system 100, whereby the evaporation pressure of the refrigerant (i.e., the refrigerant pressure of the low-pressure side) during the defrosting operation increases above the pressure during the heating operation. As a result, frost elimination on the intake pipe is facilitated.

Consequently, in the hot water system 100, the refrigeration cycle is satisfactorily achieved in the defrosting operation, and a shortening of the time needed for the defrosting operation (frost elimination) is facilitated.

Specifically, when defrosting preparatory control is not performed in defrosting operation mode (i.e., when defrosting control is executed at the same time a transition is made to defrosting operation mode), a situation could occur in which the amount of refrigerant loaded into the first heat exchanger 13 falls below the proper value at the start of the defrosting operation. When such a situation occurs, along with the decrease in the evaporation pressure of the refrigerant in the first heat exchanger 13 during the defrosting operation, the water in the first heat exchanger water passage 132 freezes. As a result, the refrigeration cycle can no longer be satisfactorily achieved during the defrosting operation, and the time needed for the defrosting operation (frost elimination) is likely to increase without frost elimination being performed smoothly.

Due to such a situation being suppressed with high precision in the hot water system 100, a shortening of the time needed for the defrosting operation (frost elimination) is facilitated. Specifically, due to defrosting preparatory control being executed before the start of the defrosting operation in the hot water system 100, the time needed for the defrosting operation (frost elimination) is shortened to roughly one half the time compared to when defrosting control is not executed.

(7) Characteristics (7-1)

In the above embodiment, when the controller 50 assess that frost has formed on the second heat exchanger 18 during heating operation mode (the heating operation), the controller transitions to defrosting operation mode. In defrosting operation mode, defrosting preparatory control is executed before defrosting control is executed in which the state of the four-way switching valve 12 is switched. In defrosting preparatory control, the opening degree of the second expansion valve 16 is narrowed and the opening degree of the third expansion valve 17 is controlled to the minimum opening degree. Specifically, before the start of the defrosting operation in which the state of the four-way switching valve 12 is switched so that the first heat exchanger 13 functions as an evaporator, the opening degree is narrowed in the second expansion valve 16 placed in the liquid refrigerant passage LP extending between the first heat exchanger 13 and the second heat exchanger 18, and the opening degree is controlled to the minimum opening degree in the third expansion valve 17 placed in the bypass passage BP extending as a branch from the liquid refrigerant passage LP.

When it is assessed that frost has formed on the second heat exchanger 18, refrigerant is thereby readily sent to the first heat exchanger 13 and readily accumulated before defrosting control is executed (i.e., before the start of the defrosting operation in which the first heat exchanger 13 functions as an evaporator). As a result, the amount of refrigerant loaded into the first heat exchanger 13 functioning as an evaporator is kept from falling below the proper value when defrosting control is executed (when the defrosting operation starts). Therefore, the decrease of refrigerant evaporation pressure in the first heat exchanger 13 is suppressed during the defrosting operation. Along with this, the water in the first heat exchanger 13 is kept from freezing as the refrigerant evaporation pressure decreases. Consequently, a satisfactory refrigeration cycle is readily achieved during the defrosting operation, and a shortening of the time needed for the defrosting operation is facilitated.

(7-2)

In the above embodiment, the controller 50 narrows the opening degree of the second expansion valve 16 in defrosting preparatory control by setting the degree of superheat target value $T_{SH}$ of the refrigerant flowing out from the second heat exchanger 18 (i.e., the refrigerant drawn into the compressor 11) to be greater than the degree during the heating operation.

The opening degree of the second expansion valve 16 is thereby controlled with high precision to the opening degree optimal for filling the first heat exchanger 13 with refrigerant, in accordance with the degree of superheat of the refrigerant (i.e., in accordance with the state of the refrigerant in the refrigerant circuit RC). As a result, before defrosting control is executed (before the defrosting operation starts), refrigerant is readily sent from the second heat exchanger 18 and the gas refrigerant passage GP to the first heat exchanger 13, and refrigerant is readily accumulated in the first heat exchanger 13. Consequently, the amount of refrigerant loaded into the first heat exchanger 13 functioning as an evaporator is kept with high precision from falling below the proper value when the defrosting operation starts.

(7-3)

In the above embodiment, during defrosting preparatory control, the controller 50 increases the rapidity (responsiveness) of the second expansion valve 16 to commands from the controller 50 to be greater than that during heating operation mode by altering the control constant used to control the second expansion valve 16.

When defrosting preparatory control is executed, the opening degree of the second expansion valve 16 is thereby quickly controlled to an opening degree optimal for filling the first heat exchanger 13 with refrigerant. As a result, the amount of refrigerant equivalent to the proper value is quickly loaded into the first heat exchanger 13 before defrosting control is executed (before the defrosting operation starts). Consequently, the time needed to complete defrosting preparatory control is shortened, and the time needed to complete the process in defrosting operation mode (i.e., the defrosting operation) is shortened.

(7-4)

In the above embodiment, the controller 50 causes the compressor 11 to be driven at the upper limit rotational speed (the maximum rotational speed) in defrosting preparatory control. Refrigerant is thereby readily sent to the first heat exchanger 13 before defrosting control is executed (before the defrosting operation starts), and the first heat exchanger 13 is readily filled with an amount of refrigerant equivalent to the proper value.

(7-5)

In the above embodiment, the controller 50 causes the fan 19 to be driven at the upper limit rotational speed (the maximum rotational speed) in defrosting preparatory control. Refrigerant is thereby readily sent to the first heat exchanger 13 before defrosting control is executed (before the defrosting operation starts), and the first heat exchanger 13 is readily filled with an amount of refrigerant equivalent to the proper value.

In the above embodiment, the controller 50 also stops the fan 19 in defrosting control. Frost elimination on the second heat exchanger 18 is thereby facilitated during the defrosting operation.

(7-6)

In the above embodiment, the controller 50 causes the compressor 11 to be driven at a lower rotational speed than the maximum rotational speed when beginning to execute defrosting control (when the defrosting operation starts). Due to this, when the defrosting operation starts, the liquid-back phenomenon in which liquid refrigerant is drawn into the compressor 11 is suppressed, although the direction of refrigerant flow is switched in accordance with that the four-way switching valve 12 is switched from the first state to the second state.

(8) Modifications (8-1) Modification A

In the above embodiment, the present invention was applied to the hot water system 100. However, the present invention is not limited thereto and may be applied to another refrigeration apparatus having a refrigerant circuit. For example, the present invention may be applied to an air-conditioning system or another refrigeration apparatus.

(8-2) Modification B

In the above embodiment, a so-called plate-type heat exchanger was employed as the first heat exchanger 13, but the first heat exchanger is not limited thereto and may be another type of heat exchanger. For example, the first heat exchanger 13 may be a so-called double-pipe type of heat exchanger or a multi-pipe cylinder type of heat exchanger.

(8-3) Modification C

In the above embodiment, the four-way switching valve 12 was employed as the passage-switching valve in the refrigerant circuit RC. However, the passage-switching valve is not necessarily limited to the four-way switching valve 12. The passage-switching valve may be configured from, e.g., a five-way valve. The passage-switching valve may also be configured from a combination of a plurality of electromagnetic valves.

(8-4) Modification D

In the above embodiment, valves that are in the fully closed state (i.e., a state of blocking the refrigerant passages) when put to the minimum opening degree were employed for the first expansion valve 15, the second expansion valve 16, and the third expansion valve 17. However, the first expansion valve 15, the second expansion valve 16, and the third expansion valve 17 are not limited thereto, and valves that are in a state forming a very small opening degree (i.e., a state forming a very small refrigerant passage) when put to the minimum opening degree may be used.

(8-5) Modification E

In the above embodiment, the compressor 11 was controlled so as to be driven at the upper limit rotational speed at the start of defrosting preparatory control. However, the compressor 11 does not necessarily need to be controlled so as to be driven at the upper limit rotational speed at the start of defrosting preparatory control, and may be controlled so as to be driven at a lower rotational speed than the upper limit rotational speed.

(8-6) Modification F

In the above embodiment, the predetermined time t1 was set to two minutes and the predetermined time t2 was set to three minutes in defrosting preparatory control. However, the predetermined times t1 and t2 are not necessarily limited to these numerical values, and can be appropriately altered in accordance with the design specifications or installation environment. For example, the predetermined time t1 may be set to one minute or three minutes. The predetermined time t2 may be set to two minutes or four minutes. The predetermined times t1 and t2 do not necessarily need to be set to a relationship of "t1<t2," and may be set to a relationship of "t1=t2."

(8-7) Modification G

In the above embodiment, the controller 50 assessed that defrosting preparatory control was completed due to the predetermined time t2 elapsing after the start of defrosting preparatory control. Specifically, the controller 50 determined whether or not defrosting preparatory control was completed on the basis of the amount of time elapsed after the start of defrosting preparatory control. However, the method of determining whether or not defrosting preparatory control is completed is not necessarily limited thereto, and can be altered as appropriate.

For example, a new pressure sensor may be placed to detect refrigerant pressure on the high-pressure side (i.e., the pressure of refrigerant flowing into the first heat exchanger refrigerant passage 131) when defrosting preparatory control is executed, and the controller 50 may be configured so as to determine whether or not defrosting preparatory control is completed on the basis of the detection value of this pressure sensor (e.g., on the basis of the detection value being equal to or greater than a predetermined threshold, or the like).

Another option is that a new pressure sensor may be placed to detect refrigerant pressure on the low-pressure side (i.e., the pressure of refrigerant flowing into the second heat exchanger 18), and the controller 50 may be configured so as to determine whether or not defrosting preparatory control is completed on the basis of the detection value of this pressure sensor (e.g., on the basis of the detection value being less than a predetermined threshold, or the like).

(8-8) Modification H

In the above embodiment, the degree of superheat target value Ts of refrigerant flowing out from the second heat exchanger 18 was set in defrosting preparatory control to be greater than the value during heating operation mode. Specifically, in defrosting preparatory control, the degree of superheat target value $T_{SH}$ was set to a value twice that during heating operation mode. However, the degree of superheat target value $T_{SH}$ during the execution of defrosting preparatory control does not necessarily need to be set to a value twice that during heating operation mode. For example, the degree of superheat target value $T_{SH}$ during the execution of defrosting preparatory control may be set to a value 1.5 or 3 times that during heating operation mode.

(8-9) Modification I

In the above embodiment, the opening degree of the second expansion valve 16 was controlled so as to be narrowed in defrosting preparatory control in order to establish a state in which a refrigerant amount equivalent to the proper value is readily loaded into the first heat exchanger 13. However, in defrosting preparatory control, the opening degree of the first expansion valve 15 may be controlled so as to be narrowed instead of the opening degree of the second expansion valve 16 being controlled so as to be narrowed. This option also makes it possible to establish a state in which a refrigerant amount equivalent to the proper value is readily loaded into the first heat exchanger 13. In this case, the first expansion valve 15 would be equivalent to the "first electric valve" in the Claims.

Another option is that the opening degrees of both the first expansion valve 15 and the second expansion valve 16 may be controlled so as to be narrowed in defrosting preparatory control. This option also makes it possible to establish a state in which a refrigerant amount equivalent to the proper value is readily loaded into the first heat exchanger 13. In this case, both the first expansion valve 15 and the second expansion valve 16 would be equivalent to the "first electric valve" in the Claims.

(8-10) Modification J

In the above embodiment, after beginning to execute defrosting preparatory control, the controller 50 caused the rotational speed of the compressor 11 to be reduced upon assessing that the predetermined time t1 had elapsed. Specifically, after beginning to execute defrosting preparatory control, the controller 50 caused the rotational speed of the compressor 11 to be reduced to a rotational speed equivalent to 30 percent of the upper limit rotational speed (the maximum rotational speed) upon assessing that the predetermined time t1 had elapsed. However, the rotational speed of the compressor 11 in this control is not necessarily limited to a rotational speed equivalent to 30 percent of the upper limit rotational speed. For example, in this control, the rotational speed of the compressor 11 may be controlled to a rotational speed equivalent to 20 percent or 40 percent of the upper limit rotational speed. This control is also not absolutely necessary in defrosting preparatory control, and can be omitted as appropriate.

(8-11) Modification K

In the above embodiment, the controls according to the following actions (I) through (III) was executed as control according to defrosting preparatory control.

(I) The compressor 11 is controlled so as to be driven at the upper limit rotational speed (the maximum rotational speed).

(II) The fan 19 is controlled so as to be driven at the upper limit rotational speed (the maximum rotational speed).

(III) The degree of superheat target value $T_{SH}$ is set greater than the value during heating operation mode.

However, the control according to defrosting preparatory control does not necessarily need to be the execution of all of these actions (I) through (III), and these actions can be omitted as appropriate. Specifically, as long as the control achieves the effect of establishing a state in which a refrigerant amount equivalent to the proper value is readily loaded into the first heat exchanger 13, the control according to defrosting preparatory control may be the execution of any one of the actions (I) through (III) alone, or the execution of a combination of any of these actions.

(8-12) Modification L

In the above embodiment, the controller 50 was placed inside the heat pump unit 10. However, the controller 50 does not necessarily need to be placed in such a manner. For example, the controller 50 may be placed inside the water storage unit 20. The controller 50 may also be divided, with one part being placed inside the heat pump unit 10 and another part being placed inside the water storage unit 20. Part or all of the controller 50 may be placed inside another unit connected by LAN, WAN, or another network.

INDUSTRIAL APPLICABILITY

The present invention can be applied to a refrigeration apparatus.

What is claimed is:

1. A refrigeration apparatus, comprising:

a compressor configured and arranged to compress refrigerant;

a first heat exchanger configured and arranged to conduct heat exchange between refrigerant and water;

a second heat exchanger configured and arranged to conduct heat exchange between refrigerant and an air flow;

a first electric valve configured and arranged to depressurize refrigerant in accordance with an opening degree thereof, the first electric valve being disposed in a first refrigerant passage, and the first refrigerant passage being a liquid refrigerant passage extending between the first heat exchanger and the second heat exchanger;

a passage-switching valve configured and arranged to switch a refrigerant flow direction in accordance with operating conditions, the passage-switching valve forming part of a refrigerant circuit together with the compressor, the first heat exchanger, the second heat exchanger, and the first electric valve;

a second electric valve configured and arranged to depressurize or block refrigerant in accordance with an opening degree thereof, the second electric valve being disposed in a second refrigerant passage branching from the first refrigerant passage and extending to an intake side of the compressor;

a supercooling heat exchanger configured and arranged to conduct heat exchange between refrigerant flowing through the first refrigerant passage and refrigerant flowing through the second refrigerant passage, the supercooling heat exchanger being disposed in the first refrigerant passage and the second refrigerant passage; and a controller configured and arranged to control the compressor, the first electric valve, the passage-switching valve, and the second electric valve, the controller having a heating operation mode and a defrosting operation mode, the controller controlling the passage-switching valve during the heating operation mode so that the first heat exchanger functions as a radiator of refrigerant and the second heat exchanger functions as an evaporator of refrigerant, the controller transitioning to the defrosting operation mode upon determining that frost has formed on the second heat exchanger during the heating operation mode, and the controller executing a defrosting preparatory control and a defrosting control after the defrosting preparatory control during the defrosting operation mode, the controller switching the passage-switching valve to switch the refrigerant flow direction during the defrosting control so that refrigerant flows through the first heat exchanger, the first heat exchanger functions as an evaporator of refrigerant and the second heat exchanger functions as a radiator of refrigerant, the controller controlling the first electric valve and the second electric valve to open during the defrosting control, and the controller narrowing the opening degree of the first electric valve and controlling the opening degree of the second electric valve to a minimum opening degree during the defrosting preparatory control.

2. The refrigeration apparatus according to claim 1, wherein the controller is further configured and arranged to control the first electric valve to narrow the opening degree of the first electric valve during the defrosting preparatory control by setting a degree of superheat target value of the refrigerant in the intake side of the compressor to be greater than a value during the heating operation mode.

3. The refrigeration apparatus according to claim 1, wherein the controller is further configured and arranged to alter a control constant used to control the first electric valve during the defrosting preparatory control.

4. The refrigeration apparatus according to claim 1, wherein the controller is further configured and arranged to cause the compressor to be driven at a maximum rotational speed during the defrosting preparatory control.

5. The refrigeration apparatus according to claim 1, further comprising a fan configured and arranged to generate the air flow, the controller being further configured and arranged to cause the fan to be driven at a maximum rotational speed during the defrosting preparatory control and to stop the fan during the defrosting control.

6. The refrigeration apparatus according to claim 1, wherein the controller is further configured and arranged to cause the compressor to be driven at a rotational speed lower than a maximum rotational speed during the defrosting control.

7. The refrigeration apparatus according to claim 2, wherein the controller is further configured and arranged to alter a control constant used to control the first electric valve during the defrosting preparatory control.

8. The refrigeration apparatus according to claim 2, wherein the controller is further configured and arranged to cause the compressor to be driven at a maximum rotational speed during the defrosting preparatory control.

9. The refrigeration apparatus according to claim 2, further comprising a fan configured and arranged to generate the air flow, the controller being further configured and arranged to cause the fan to be driven at a maximum rotational speed during the defrosting preparatory control and to stop the fan during the defrosting control.

10. The refrigeration apparatus according to claim 2, wherein the controller is further configured and arranged to cause the compressor to be driven at a rotational speed lower than a maximum rotational speed during the defrosting control.

11. The refrigeration apparatus according to claim 3, wherein the controller is further configured and arranged to cause the compressor to be driven at a maximum rotational speed during the defrosting preparatory control.

12. The refrigeration apparatus according to claim 3, further comprising a fan configured and arranged to generate the air flow, the controller being further configured and arranged to cause the fan to be driven at a maximum rotational speed during the defrosting preparatory control and to stop the fan during the defrosting control.

13. The refrigeration apparatus according to claim 3, wherein the controller is further configured and arranged to cause the compressor to be driven at a rotational speed lower than a maximum rotational speed during the defrosting control.

14. The refrigeration apparatus according to claim 4, further comprising a fan configured and arranged to generate the air flow, the controller being further configured and arranged to cause the fan to be driven at a maximum rotational speed during the defrosting preparatory control and to stop the fan during the defrosting control.

15. The refrigeration apparatus according to claim 4, wherein the controller is further configured and arranged to cause the compressor to be driven at a rotational speed lower than the maximum rotational speed during the defrosting control.

16. The refrigeration apparatus according to claim 5, wherein the controller is further configured and arranged to cause the compressor to be driven at a rotational speed lower than a maximum rotational speed during the defrosting control.

17. The refrigeration apparatus according to claim 7, wherein the controller is further configured and arranged to cause the compressor to be driven at a maximum rotational speed during the defrosting preparatory control.

18. The refrigeration apparatus according to claim 7, further comprising a fan configured and arranged to generate the air flow, the controller being further configured and arranged to cause the fan to be driven at a maximum rotational speed during the defrosting preparatory control and to stop the fan during the defrosting control.

19. The refrigeration apparatus according to claim 7, wherein the controller is further configured and arranged to cause the compressor to be driven at a rotational speed lower than a maximum rotational speed during the defrosting control.

20. The refrigeration apparatus according to claim 8, further comprising a fan configured and arranged to generate the air flow, the controller being further configured and arranged to cause the fan to be driven at a maximum rotational speed during the defrosting preparatory control and to stop the fan during the defrosting control.

* * * * *